US005718103A

United States Patent [19]

Spada

[11] Patent Number: 5,718,103

[45] Date of Patent: Feb. 17, 1998

[54] PROCESS AND DEVICE FOR PACKAGING PRODUCTS, PARTICULARLY CYLINDRICAL PRODUCTS SUCH AS CIGARETTES, OR THE LIKE, IN A WRAPPING SHEET

[75] Inventor: Valter Spada, Marzabotto, Italy

[73] Assignee: Sasib S.p.A., Bologna, Italy

[21] Appl. No.: 633,471

[22] Filed: Apr. 17, 1996

[30] Foreign Application Priority Data

Apr. 27, 1995 [IT] Italy ..... GE95A0044

[51] Int. Cl.[6] ..... B65B 11/00

[52] U.S. Cl. ..... 53/466; 53/148; 53/444; 53/228; 53/234

[58] Field of Search ..... 53/444, 466, 148, 53/231, 228, 229, 232, 234

[56] References Cited

U.S. PATENT DOCUMENTS

| | | | |
|---|---|---|---|
| 3,911,645 | 10/1975 | Schmermund . | |
| 4,085,568 | 4/1978 | Focke et al. | 53/234 |
| 4,092,816 | 6/1978 | Seragnoli | 53/234 |
| 4,183,191 | 1/1980 | Focke | 53/234 X |
| 4,202,151 | 5/1980 | Focke et al. | 53/234 X |
| 4,509,310 | 4/1985 | Focke et al. . | |
| 4,887,408 | 12/1989 | Mattei et al. . | |

*Primary Examiner*—Daniel Moon
*Attorney, Agent, or Firm*—Larson & Taylor

[57] ABSTRACT

A process and a device for packaging products, particularly cylindrical products such as cigarettes, or the like, in a wrapping sheet, and involves wrapping an ordered group of cigarettes (S) in a wrapping sheet (2) and forming a first tubular wrapping open at its opposing ends and provided with portions (402, 502, 602, 702) projecting beyond the corresponding sides of the group of cigarettes. The ends of the tubular wrapping are closed by the successive folding of the various flaps or various wings (402, 502, 602, 702) forming the projecting portions against the corresponding side of the group of cigarettes (S). The formation of the tubular wrapping open at its ends is carried out in the feed station (A), while the closing of the open ends is carried out completely in only one of the successive stations (P), the whole being done by means of particular shaping, arrangement and operation of movable folding devices (6, 15, 25, 26) and stationary folding devices (5, 105, 205, 605) and of the forming wheel (1).

28 Claims, 14 Drawing Sheets

PROCESS AND DEVICE FOR PACKAGING PRODUCTS, PARTICULARLY CYLINDRICAL PRODUCTS SUCH AS CIGARETTES, OR THE LIKE, IN A WRAPPING SHEET

BACKGROUND OF THE INVENTION

The invention relates to a process and to a device for packaging products, particularly cylindrical products such as cigarettes, or the like, in a wrapping sheet.

The process according to the invention comprises the following stages:

- forming a group of cigarettes with a predetermined number and order corresponding to those in the packed state;
- combining the group of cigarettes with a wrapping sheet in a predetermined relative position and inserting them into a containing compartment with simultaneous folding of the wrapping sheet into a "C" shape around the sides of the group of cigarettes associated with the closed sides of the containing compartment;
- forming a tubular wrapping by folding and retaining in position the flaps of the wrapping sheet on that side of the group of cigarettes at the open entrance side of the containing compartment;
- subsequently closing the open ends of the tubular wrapping by folding wings formed by the terminal portions at the ends of the tubular wrapping projecting beyond the corresponding sides of the group of cigarettes.

These folding stages are at present carried out by folding means which are distributed over a plurality of stations along a predetermined path along which the ordered group of cigarettes are conveyed between a station for feeding the group together with the wrapping sheet and a station for discharging the ordered group of cigarettes completely wrapped in the wrapping sheet. The conveyor means are step-driven and the folding stages require a considerable period of time for each pack, since the considerable number of stations necessitates relatively long conveying paths between the feed station and the discharge station.

Moreover, the folding executed in a plurality of stations requires means which maintain the flaps and wings folded in the preceding stations in position, making the construction of the device more complicated. This necessity of retaining the folded flaps and wings in position part-way through the procedure for wrapping the group of cigarettes becomes more inconvenient when a more elastic material, with a shorter recovery time, is used in place of the normal tin foil sheet. In this case, the forming means used at present do not ensure a perfect wrapping of the group of cigarettes at all times, since they are constructed for materials such as tin foil, which retain the fold better.

SUMMARY OF THE INVENTION

The invention is therefore based on the object of providing a process and a device of the type described initially, in such a form that, by means of simple and economically advantageous arrangements, it becomes possible to limit the effects on operating speed, in other words on the pack wrapping time, and consequently to improve the efficiency of the packaging devices, and also to use new materials with differing degrees of elasticity and of recovery, in other words of returning to the initial state after folding.

The invention achieves the above objects with a process of the type described initially in which the complete formation of the pack, in other words the complete folding of the wrapping sheet around the ordered group of cigarettes, is executed in two stations only, in other words in the station where the group of cigarettes and the wrapping sheet are fed into the containing compartment and in only one of the subsequent stations, known as the folding station, the pack being completely formed when it leaves the said folding station, the forming of the open tubular wrapping being executed substantially in the feed station and completed during the step of advance, in other words in the initial portion of the step of advance, and the closing on the ends of the tubular wrapping being completed simultaneously for both opposite ends of the tubular wrapping in the subsequent folding station, while in the next step of advance the completely formed wrapping is simply kept closed until the discharge station is reached.

The folding station is advantageously the one immediately following the feed station, so that the ordered group of cigarettes is already completely wrapped in the wrapping sheet before the start of the second step of advance.

The process provides for the folding of the wrapping sheet to close the open sides in such a way that the flaps or wings are folded in succession with one being superimposed on another, at least partially, starting with the lowest to the outermost, at a speed higher than the speed of elastic return to the substantially unfolded position or to an intermediate position of folding of the said wings or flaps, while the final upper flap or wing is kept in position folded against the corresponding side of the group of cigarettes and against the other lower flaps or wings until the group of cigarettes, wrapped in this way in the wrapping sheet, is discharged.

As an alternative, the process provides for at least one peripheral strip for superimposition of an upper flap or wing to be left free on the lower flaps or wings, this peripheral superimposition strip being provided on a directly adjacent side next to or facing the subsequent upper flap or wing, in other words a part of the flap which is folded into position first, the lower wing or flap being kept in the folded position only until the upper folding wing or flap is at least partially superimposed on to the free superimposition strip.

The invention also relates to a device for the application of the said process, which comprises:

- means for forming an ordered group of cigarettes;
- means for feeding the said group together with a wrapping sheet into a containing compartment open at least at one entry side and at two sides transverse with respect to it;
- means for conveying the said containing compartment;
- movable and/or stationary folding means which are distributed along the path of the compartment for containing the group of cigarettes to be packed and the associated wrapping sheet, these means being designed to fold the wrapping sheet around the group of cigarettes to form a first tubular wrapping and subsequently to close the open ends of the said tubular wrapping.

According to the invention, the movable and/or stationary folding means are provided only in the feed station and in only one of the subsequent stations, in other words a folding station for completing the packaging wrapper.

The folding means are shaped in such a way with respect to the flaps or wings and/or are operated in such a way that they stop at a certain distance from a free edge of the said flaps or wings, leaving free a partial or complete strip for the superimposition of the subsequent flap or wing, on that side which is reached first by the folder of the said subsequent wing or flap, the folding means and the operating and synchronizing means being made in such a way that the folding means of the lower wings or flaps and those of the wings and flaps directly above do not interfere with each other, while means are provided which advance the start of the folding movement of the folding means of the upper wing or flap with respect to the return movement of the folder of the flap or wing immediately below, this advance corresponding to the movement required for the superimposition of the said upper flap or wing on the free peripheral superimposition strip of the lower flap or wing.

According to a further improvement, the folding means are made in such a way that they are disposed in a stand-by position directly next to the wings or flaps of the wrapping sheet which have not yet been folded, or are brought into this position during the idle or waiting time of these or of other folders, and with the folding edge substantially aligned and/or coinciding with the predetermined folding line.

In a preferred embodiment, the wrapping sheet is wrapped in a tubular form around the group of cigarettes, along an axis perpendicular to the direction of transport, while the open side of the containing compartment is orientated parallel to the direction of transport or at a tangent and/or secant to the said direction of transport.

In this case, at least one stationary folder and at least one tangential movable folder are provided in the station for feeding the group of cigarettes into the containing compartment, and are disposed opposite each other with respect to the advance of the containing compartment, the tangential movable folder being capable of being driven alternately forwards and backwards, in the direction of advance of the containing compartment or in a direction tangential to the path of advance and transverse with respect to the flap of the wrapping to be folded, with the provision of means of synchronized activation of the reciprocating motion of the tangential folder with the advance of the containing compartment and means of limiting the advance and return movements of the movable folder, these means being made in such a way that the movement of advance takes place in the direction of advance of the containing compartment, and is advanced to such an extent with respect to the step of advance of the said compartment that the folder assumes a stable relative position with respect to the free edge of the folded flap, forming a front peripheral strip which is transverse with respect to the step of advance of the containing compartment, this strip being designed to be partially inserted for a certain distance under the stationary folder and under the part of the flap folded by it, before the said movable folder starts its return movement in the direction opposite the direction of advance of the containing compartment.

In the folding station, movable means for folding the projecting end portions of the tubular wrapping are provided for each open end of the tubular wrapping, the end portions comprising at least one pair of first wings opposite each other and orientated tangentially to the direction of advance or in the direction of advance of the containing compartment, and at least two further, second wings opposite each other, joined at their ends to the two tangential wings and orientated transversely, preferably perpendicularly, with respect to the said tangential wings and to the direction of advance of the containing compartment, the movable folders of the first wings consisting of a surface which can oscillate about an axis coinciding with the folding line, in other words with the edge of the corresponding side of the group of cigarettes, from a position in which it is substantially aligned with and externally superimposed on the said wings in the unfolded state to the folded position of the wings, in which the folding surface which can oscillate is turned over against the corresponding side of the group of cigarettes, and the folders of the second wings consisting of two blades opposite each other and with a folding edge movable to a position coinciding with the folding line of the said second wings, in other words with the corresponding edge of the side of the group of cigarettes, these folding blades being capable of being driven with a sliding motion parallel and tangential to the plane containing the corresponding side of the group of cigarettes, one blade being driven in a direction opposite that of the other, and the blades being driven alternately, so that each carries out a folding movement in which the folding blades are at least partially superimposed on the corresponding side of the group of cigarettes and a return movement to the rest and/or stand-by position.

The invention also relates to other characteristics which further improve the process and the device described above and which form the subject of the dependent claims.

BRIEF DESCRIPTION OF THE DRAWINGS

The particular characteristics of the invention, and the advantages derived therefrom, will be more clearly understood from the description of some preferred embodiments, illustrated by way of example and without restriction in the attached drawings, in which.

DESCRIPTION OF THE PREFERRED EMBODIMENT TO THE INVENTION

Figure 1:
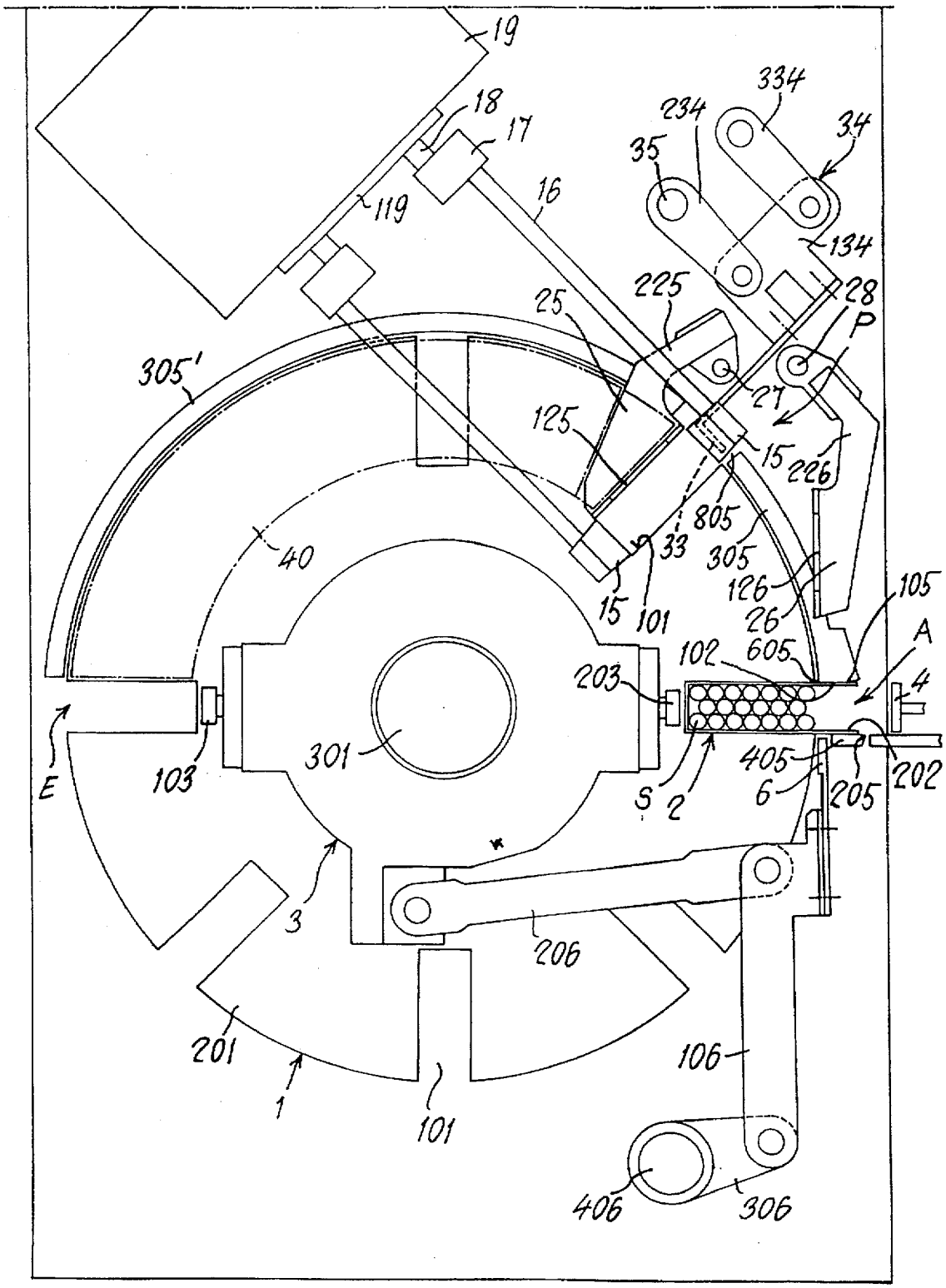
FIG. 1 is a schematic front view of a forming wheel provided according to the invention.

With reference to FIGS. 1 to 9, a cigarette packing machine comprises a conveyor drum 1, known as a forming wheel, which is supported rotatably about its own axis on a shaft 301 from which it projects. The forming wheel 1 has a plurality of peripheral radial compartments 101, each of which can contain a group of cigarettes S together with a wrapping sheet 2 for the said group of cigarettes. The containing compartments 101 are formed by axially coinciding recesses of rectangular shape, corresponding to that of the wrapping of the group of cigarettes, these recesses being made in two adjacent discs 201 which form the sides of the forming wheel 1. The containing compartments 101 are distributed at equal angular intervals along the circumference of the forming wheel 1 and the wheel is made to rotate in steps with an angular size corresponding to the angular distance between the individual containing compartments 101.

In the central part of the wheel, between the two discs 201, there is a pusher and guide unit indicated overall by the number 3, which has an expelling pusher 103 and a guide 203 on each of its diametrically opposite sides. The expelling pusher 103 and the guide 203 can be driven so that they slide in diametrically opposite directions and interact with the group of cigarettes S together with the sheet 2 in the feed station A and with the wrapped group of cigarettes in the wrapping sheet 2 in the discharge station E on the diametrically opposite side. The group of cigarettes S has a predetermined number of cigarettes with an ordered disposition corresponding to that which the cigarettes are intended to have in the packed state. The group of cigarettes S is orientated with the axis of the cigarettes parallel to the axis of the forming wheel 1, while the ends of the cigarettes are disposed substantially flush with the outer faces of the discs 201. The group of cigarettes is formed by feeding a specified number of cigarettes into housings of predetermined shape associated with a conveyor belt, known as a box conveyor, which is known per se and is not illustrated. Each group of cigarettes is then brought into a transfer station and then into a station for combination with a wrapping sheet. In the station for combination with a wrapping sheet, the group of cigarettes is disposed so that it coincides with the complementary containing compartment 101 and is in front of the open entry side of the compartment, in such a way that it can be introduced into the compartment by movement in a direction transverse with respect to the cigarettes and radial with respect to the forming wheel 1. In the combination station, a wrapping sheet 2 is fed on to the transverse side of the group of cigarettes S, while the sheet and the group of cigarettes are kept in position and then transferred together to the containing compartment 101 by a feed pusher 4 which interacts with the guide 203 and can be moved together with it. At the time of insertion into the containing compartment 101, the wrapping sheet is automatically folded around the sides of the group of cigarettes S inside the containing compartment 101, while axial flaps 102, 202 of the sheet project radially outside the entrance aperture of the said containing compartment 101.

The folding of the wrapping sheet 2 around the ordered group of cigarettes at the time of insertion into the containing compartment 101 is caused by two opposing folding edges 105, 205 of a stationary aperture 5 which is provided in a position coinciding with the open side of the containing compartment 101 in the feed station A and which is made in a stationary cylindrical coaxial peripheral wall 305 which extends around the forming wheel 1.

A tangential folder 6 is supported so that it can be moved parallel to its extension and alternately in both directions, in other words in the direction of advance of the forming wheel 1 and in the opposite direction, substantially along a path tangential to the forming wheel 1, in other words to the open side of the containing compartment 101 in the feed station A. The folder is fitted on the upper end of an arm 106 which is hinged at an intermediate point to a freely oscillating lever 206, while its opposite end is hinged to a link 306 which rotates integrally with a shaft 406.

Figure 2:
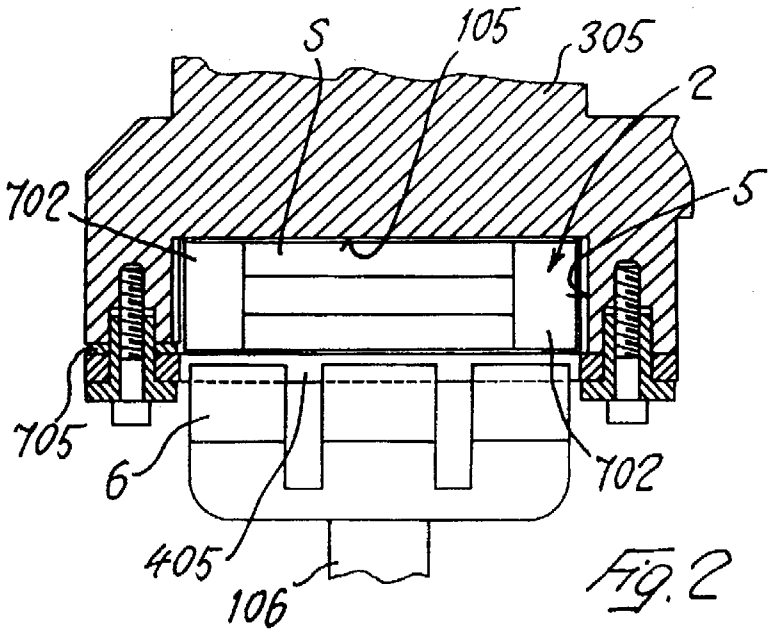
FIG. 2 is a schematic view in the direction of feed of the group of cigarettes into the containing compartment of a forming wheel.

With reference to FIG. 2, the folder 6 is made in the form of a comb and has segments separated by interstices, which pass through complementary slots separated by ribs provided in a horizontal sliding surface 405 which forms the lower edge 205 of the aperture 5.

Figure 3:
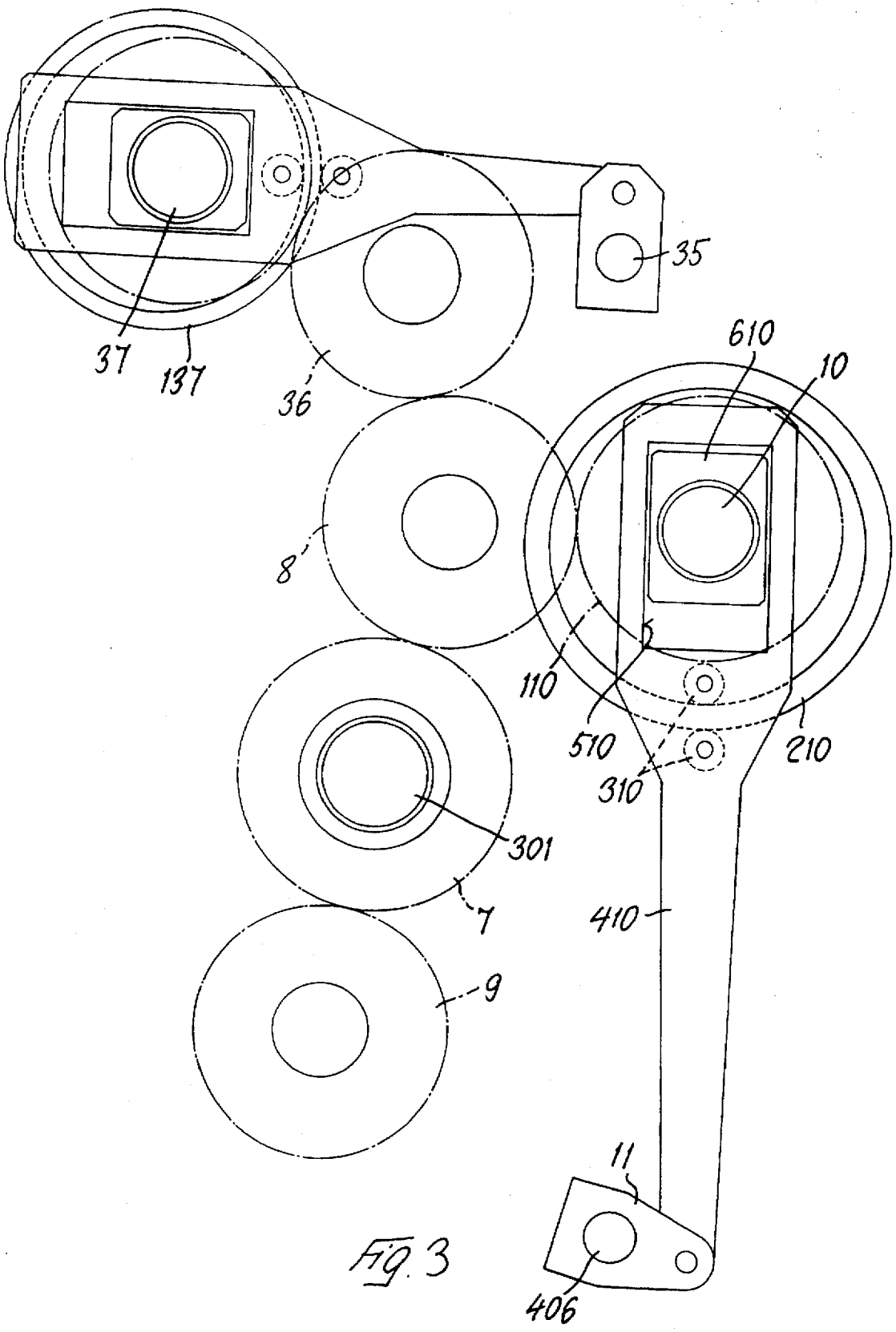
FIG. 3 is a schematic illustration of the transmission and drive system for synchronizing the steps of advance of the forming wheel with the drive of the folding means.

With reference to FIG. 3, the shaft 406 is driven in synchronization with the stepped drive of the forming wheel 1 by means of a transmission system which comprises a pair of gears 7, 8 which transfer the motion from a driven gear 9, which also drives the forming wheel 1, to a gear 110 keyed to a shaft 10 which rotates a cam 210. The cam 210 interacts with a pair of rollers 310 which are supported in an intermediate position by a sliding bar 410. The bar 410 is supported slidably longitudinally and radially with respect to the shaft 10 by its end 510 in the form of a slider which is mounted on a guide 610 carried on, and freely rotatable with respect to, the shaft 10. The opposite end of the bar 410 is hinged to a lever 11 which is fixed on and rotates integrally with the shaft 406 for driving the tangential folder 6.

Figure 11:
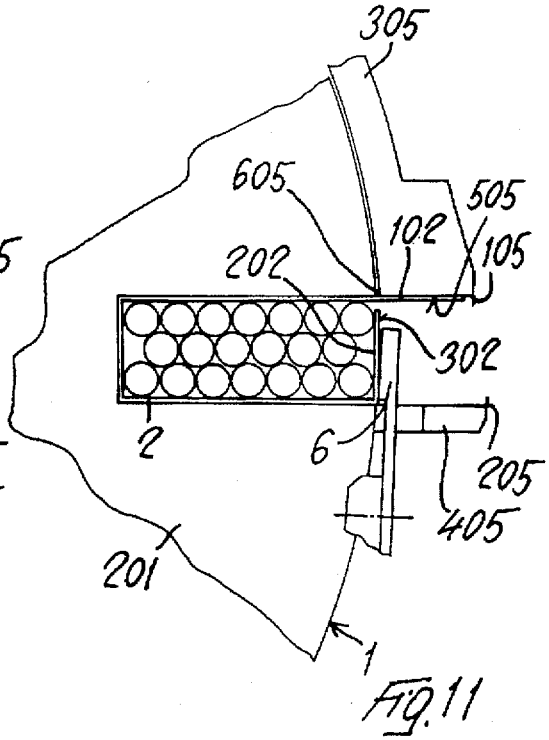

FIGS. 10 to 13 show the stages of folding of the flaps 102, 202 of the wrapping sheet 2 for the formation of a tubular wrapping open at its ends, the axis of which is parallel to the axes of the cigarettes S and to the axis of the forming wheel. The lengths of the two flaps 102, 202 are such that, when folded against the side of the group of cigarettes coinciding with the open side of the containing compartment 101, the flaps overlap each other by a certain amount. In the starting condition shown in FIG. 10, the flaps 102, 202 extend along two horizontal radial walls 405, 505 which are made to be aligned flush with the folding corners 105, 205 of the aperture 5 and which form containing walls for the said flaps 102, 202. During the stage in which the containing compartment 101 remains in the feed station A, the tangential folder 6, which is in the withdrawn position with respect to the containing surface 405 and backward with reference to the direction of advance of the forming wheel 1 (FIG. 10), begins the folding movement with which it moves in the direction of advance of the forming wheel 1 and substantially tangentially to the said wheel, in other words parallel to the corresponding side of the group of cigarettes S (FIG. 11). The flap 202 is therefore folded against the corresponding side of the group of cigarettes S. The forming wheel 1 executes the advance step with a predetermined delay with respect to the advance movement of the tangential folder 6. This delay and the two speeds of advance of the forming wheel 1 and of the folding blade 6 are such that the folder 6 terminates its movement relative to the flap 202 of the wrapping sheet 2 in such a position that the front edge of the folder 6 is withdrawn by a certain distance with respect to the free front edge of the flap 202, forming a free front strip 302. The horizontal surface containing the front flap 102 of the wrapping sheet 2 reaches a position in which its corner 605 for folding the said flap 102 is partially superimposed on the previously folded rear flap 202, with a stationary cylindrical surface which is coaxial with the forming wheel 1 of a peripheral wall 305 and covers the radially external open side of the compartments 101 over a predetermined arc of the path of advance, in particular over the angular distance between the feed station A and the subsequent folding station P.

The corner 605 for folding the front flap 102 is disposed in a position aligned with and substantially directly adjacent to the edge of the open side of the containing compartments 101 in the feed station A.

Figure 12:
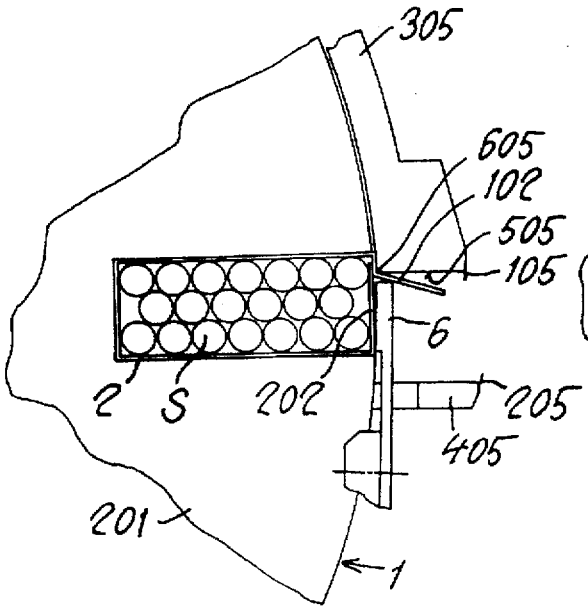
Figure 13:
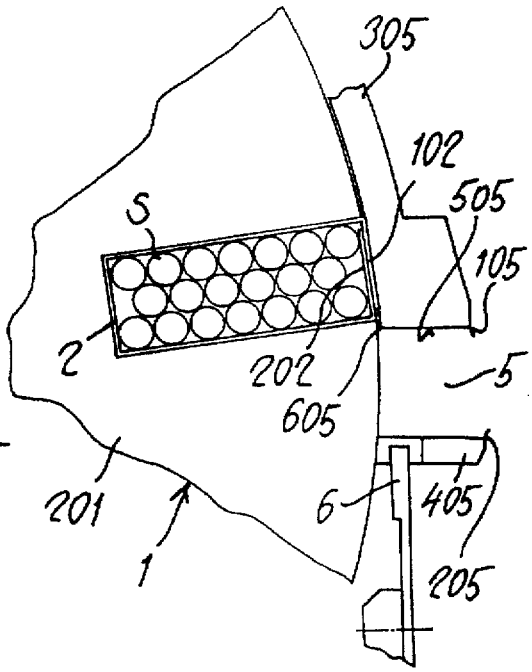

As shown in FIG. 12, the reaching of a fixed relative position of the tangential folder 6 with respect to the rear flap 202 causes the folder 6 to approach the corner 605 for folding the front flap 102. The extension of the front superimposition strip 302 in the direction of advance of the forming wheel 1 and the folding movement of the folder 6 in the direction of advance of the forming wheel 1 are such that the tangential folder 6 reverses its movement at a predetermined minimum distance from the corner 605 for folding the front flap 102. When the said minimum distance is reached, the front superimposition strip 302 of the rear flap 202 has penetrated under the folding corner 605, which has superimposed on this flap, having folded it, an initial partial portion of the front flap 102. In these conditions, the folded rear flap 202 is kept in position by the front flap 102 which is partially superimposed on it and the folder 6 can completely depart from the position of the folding of the associated rear flap 202, returning to the withdrawn starting position for a new folding movement. In the meantime, the advance of the forming wheel 1 causes the completion of the folding of the front flap 102 on to the corresponding side of the group of cigarettes. During the step of advance and up to the subsequent folding station P the flap 102, which is in a position of superimposition on all the remaining flaps, is kept in the said folded position by the cylindrical surface of the wall 305.

Since the cigarettes, particularly those with filters, may have diameters which differ slightly between the filter and the cigarette, and the said two parts have different degrees of deformability, and in particular of compressibility, it is possible that, during the initial folding of the wrapping sheet 2 into a C shape in the passage across the aperture 5, the section of the group of cigarettes S in a plane parallel to the aperture 5 may assume a trapezoidal shape which then leads to the formation of a frustoconical tubular wrapping with different projections of the flaps 102, 202 at the two ends and a slightly helicoidal shape of the wrapping sheet 2 folded into a C shape, or the formation of pleats, etc.

To avoid such problems, the invention provides compensating means which in the illustrated embodiment consist of means of fine adjustment of the distance between the two opposite folding edges 105, 205, at least at one of the two ends. With reference to FIG. 2, the aperture 5 is formed by a fork-shaped end of the cylindrical wall 305 which extends to the feed station A and which forms the lateral walls and the folding corner 105 which is at the front with reference to the direction of advance of the forming wheel 1. The opposite folding corner 205 is formed by the front edge of a plate 405 which is fixed to the ends of the lateral branches of the fork. The two lateral branches of the fork are of different lengths, while the distance between the two folding corners 105, 205 at the two ends is adjusted by the interposition of a spacing washer 705 with a suitably adjusted thickness between the said plate and at least one of the branches of the fork. The spacing washer 705 may be replaced with washers of different thicknesses which may be fitted singly or in combination, or may be suitably reduced in thickness as required at the time of the adjustment of the device.

In the subsequent folding station P folding means are provided to close the open ends of the tubular wrapping formed in the feed station A and completed in the initial section of the step of advance of the containing compartment 101.

Figure 8:
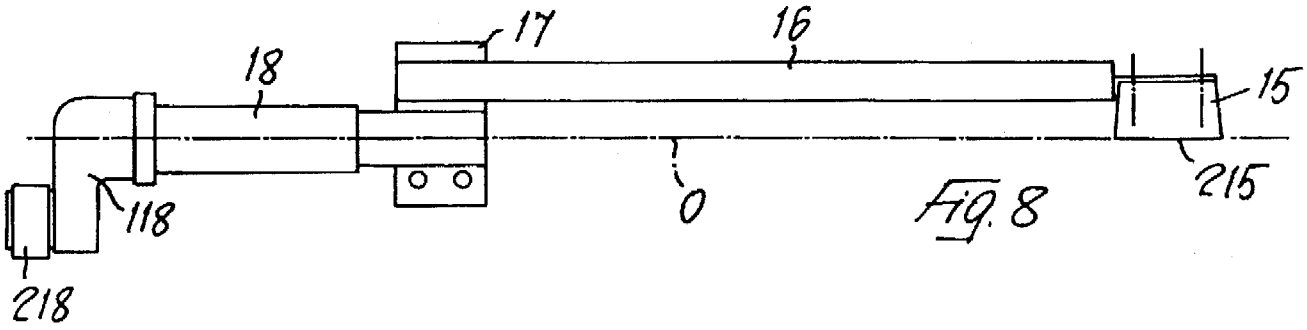
FIG. 8 is a view of a folder with the supporting bar, the oscillating drive shaft and the elbow joint end.
Figure 9:
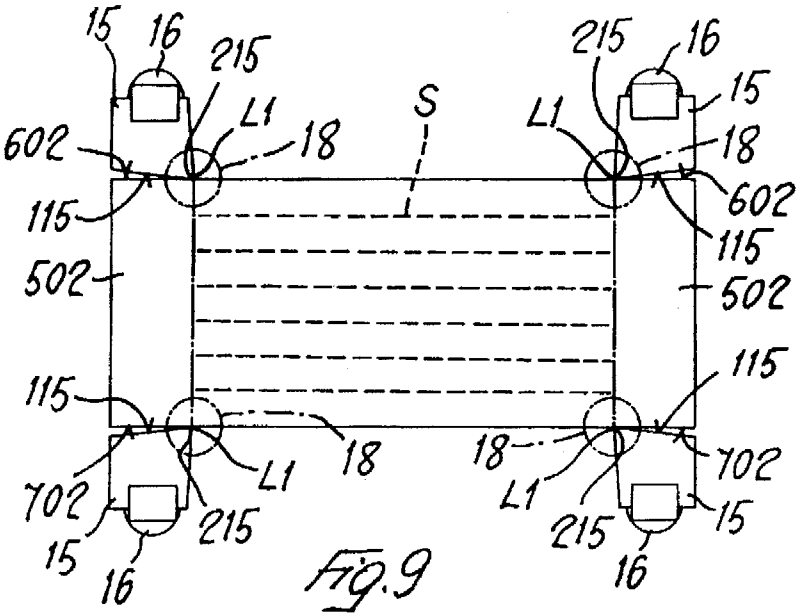
FIG. 9 is a view of the front radial side, transverse with respect to the direction of transport, of the group of cigarettes between the folders of the flaps tangential to the direction of advance.

The tubular wrapping formed by the sheet 2 has tubular end portions projecting beyond the ends of the cigarettes aligned with each other at their ends and forming opposite pairs of wings orientated in the radial direction 402, 502 and in the tangential direction 602, 702 with respect to the forming wheel 1, these wings being joined together at the axial contact corners. With reference to FIGS. 1, 8, 9, a pair of folding blocks 15 is provided in the folding station P on each side of the forming wheel 1 to fold the radially inner tangential wing 602 and the radially outer tangential wing 702. The folding blocks 15 are disposed outside the corresponding wing 602, 702 and have folding surfaces 115 each of which terminates in a free edge substantially coinciding with or directly adjacent to the folding line L1 of the corresponding wing 602, 702 which coincides with the edge of the corresponding side of the group of cigarettes. The said free edge advantageously consists of a sharp corner 215 of the folding block 15, while the surface 115 in the rest position is disposed so that it diverges in the radial direction of the forming wheel 1 from the wing 602, 702. By this means, the group of cigarettes wrapped in the tubular wrapping may be introduced between the four folding blocks 15 in the rest position, without the possibility of these blocks interfering with the projecting ends of the tubular wrapping, which might cause unintended and undesirable folding. The blocks 15 can oscillate about an axis 0 which coincides with the corner 215. For this purpose, as shown in FIGS. 1 and 6 to 9, each folding block 15 is supported by a bar 16 which is parallel to the axis of oscillation 0 of the folding blocks 15. One end of the bar 16 is fixed to the end of a radial arm 17 which rotates integrally with a shaft 18. The folding block 15 is fixed to, and projects from, the opposite end of the bar 16, in such a way that the line joining the axis of the bar 16 and the corner 215 is axially aligned with the radial am 17, while the corner 215 is made to coincide with the extension of the axis 0 of the shaft 18 (FIG. 8). The shafts 18 are supported so that they can rotate freely in a wall 119 of a casing 19, and their inner ends rotate integrally with a crank 118 which carries an eccentric roller 218 which is rotatable about an axis parallel to the axis 0 of the shaft 18, this roller engaging slidably in a transverse guide in the form of a link 20 which is movable in an alternating way in a direction perpendicular to its longitudinal extension.

The transverse guides 20 are fitted so that they can be removed and adjusted with respect to their position by means of a securing device or clamps 120 on respectively two arms 121, which are perpendicular to the guides and parallel to each other and which form part of an articulated quadrilateral indicated overall by the number 21. The ends of the arms 121 are interconnected by oscillating levers 221, 321 which are parallel to each other and which are hinged so that they can oscillate freely about perpendicular central axes 521, 621 which are aligned with each other in a direction parallel to the arms 121, 221. The articulated parallelogram 21 is driven with a reciprocating motion by means of a bar 22 which is hinged between a median radial extension 721 of the oscillating lever 321 and a radial projection 123" of a shaft 223 of what is known as an intermittent/oscillating drive device 23, for example of the type with a cylindrical and/or spheroidal cam 323 (such as the type marketed by Colombo Filippetti of Casirate d'Adda, BG).

This construction makes it possible to adapt the relative disposition of the folding blocks 15 to the various cigarette and pack formats in a relatively rapid and simple way. In this case, it is sufficient to dismount the plate 119 with the shafts 18 and the bars 16. These may easily be mounted on another plate, in which the journals for the shafts 18 are provided in different relative positions. The connection of the cranks 118 in the corresponding guides 20 and their adjustment is extremely rapid and simple.

Figure 4:
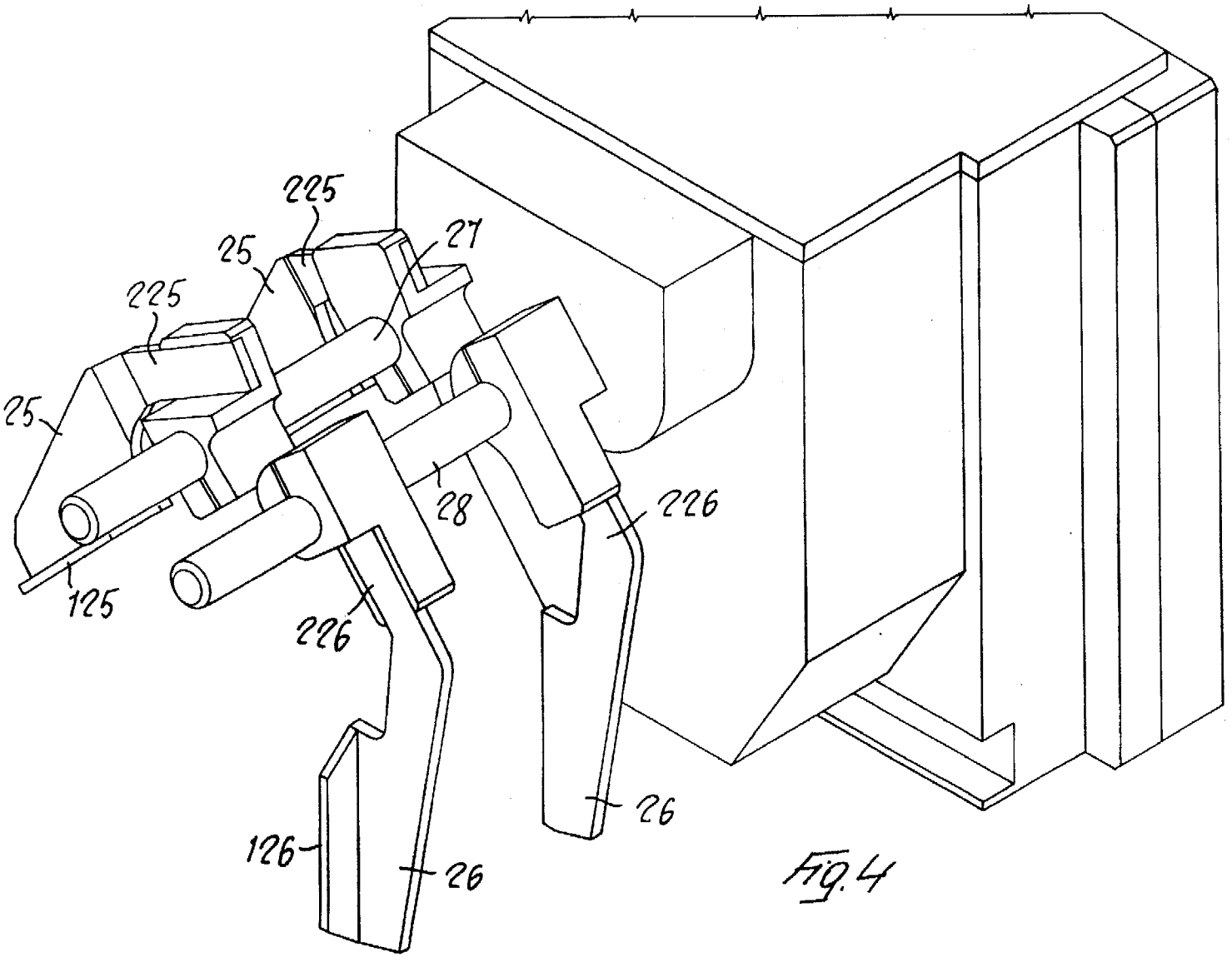
FIG. 4 is a schematic axonometric view of the oscillating blades for folding the radial flaps on the open ends of the tubular wrapping on both ends of the group of cigarettes.
Figure 15:
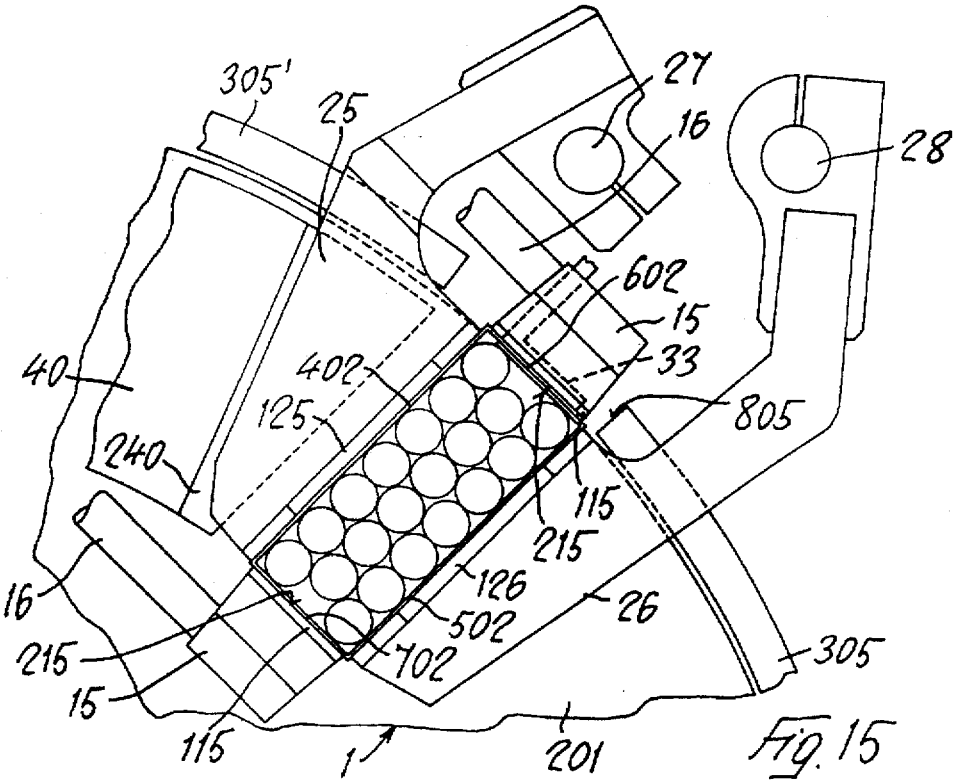
Figure 16:
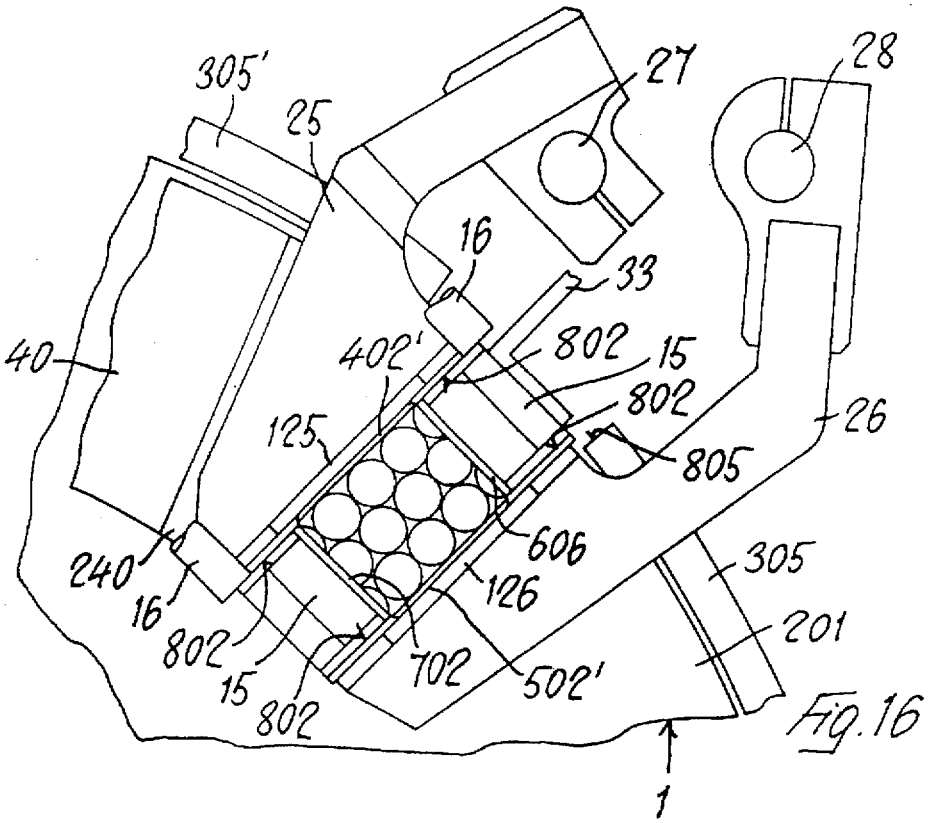
Figure 17:
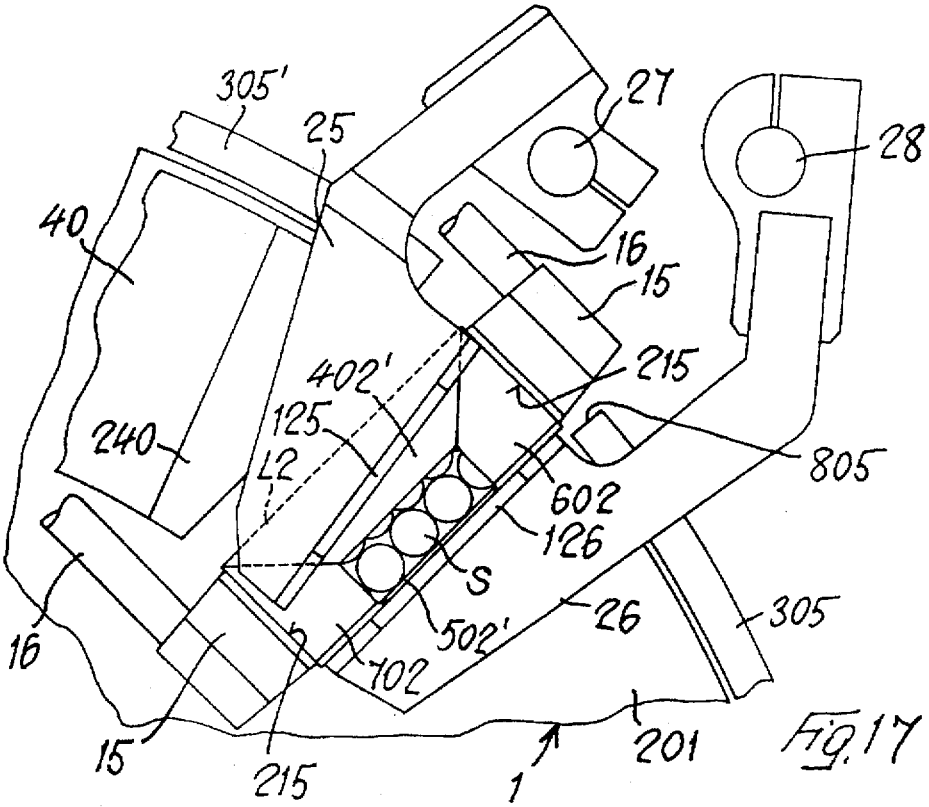

A pair of opposing folding blades 25, 26 is provided on each side of the forming wheel 1 to fold the radial wings 402, 502 of the ends of the tubular wrapping projecting beyond the ends of the cigarettes S. The folding blades extend parallel and tangentially to the plane containing the ends of the cigarettes and can oscillate parallel to each other in the said tangential plane, alternately in the direction of advance of the forming wheel 1 and in the opposite direction on a path forming a secant to the wheel 1. Each folding blade 25, 26 has a transverse extension 125, 126 on the side facing the corresponding radial wing 402, 502. The trajectory of oscillation of the said folding blades 25, 26 is such that, during the stage in which the containing compartment101 remains in the folding station P, the blades can assume a stand-by position (FIG. 15) in which they are swung into a position in which the extensions 125, 126 are aligned with the external surface of the corresponding side of the tubular wrapping, and in which they are in contact with the associated wings 402, 502, thus forming containing surfaces for the said wings 402, 502, as a substantial axial extension of the corresponding radial walls of the containing compartments 101. Each blade 25, 26 is carried on and projects from an arm 225, 226. The ends of the arms 225, 226 are fixed to and rotate integrally with associated driving shafts 27, 28. Each driving shaft 27, 28 carries the two corresponding folding blades 25, 26 on the two opposite sides of the forming wheel 1 (FIG. 4).

Figure 5:
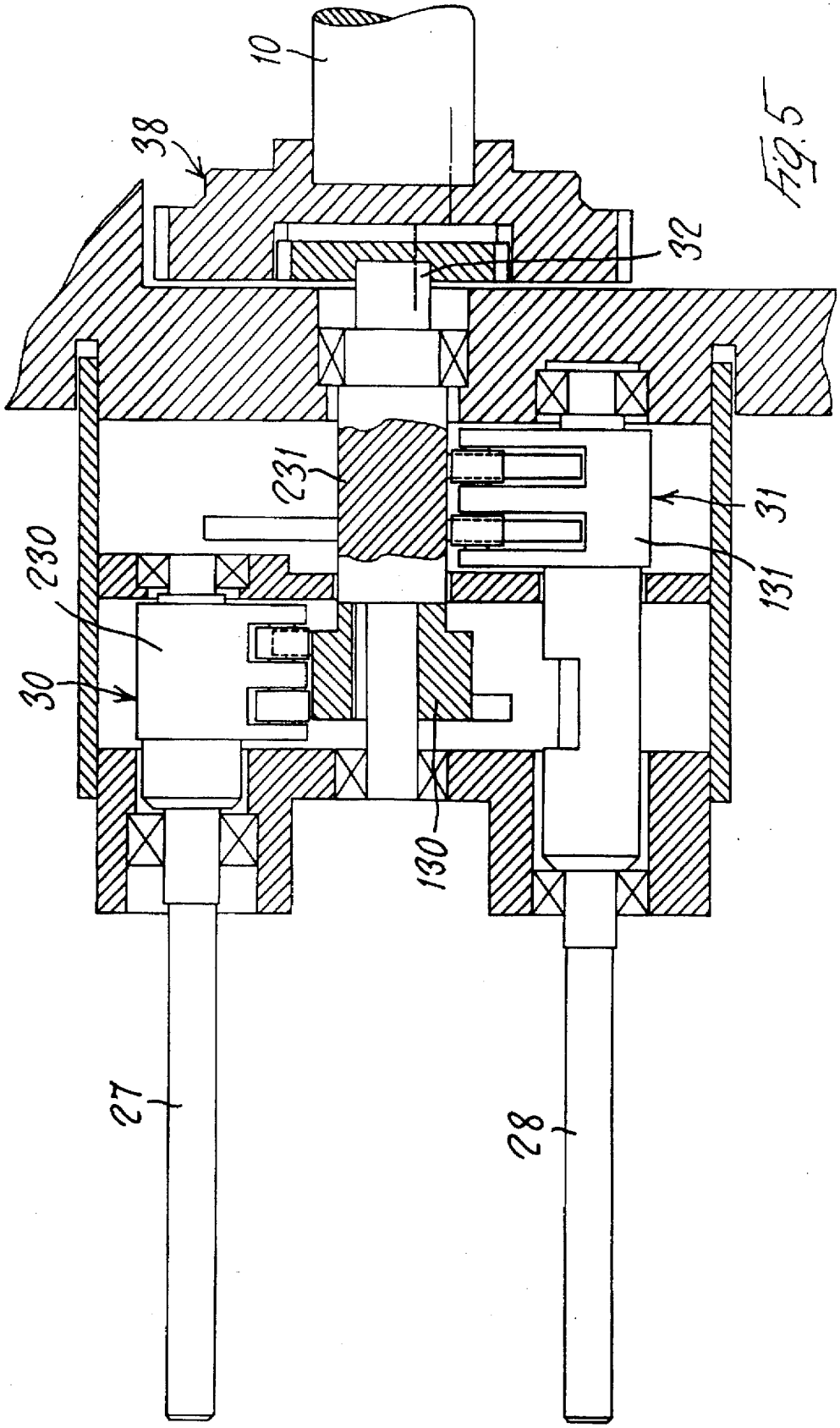
FIG. 5 shows the transmission means for the synchronized operation of the oscillating blades.
Figure 6:
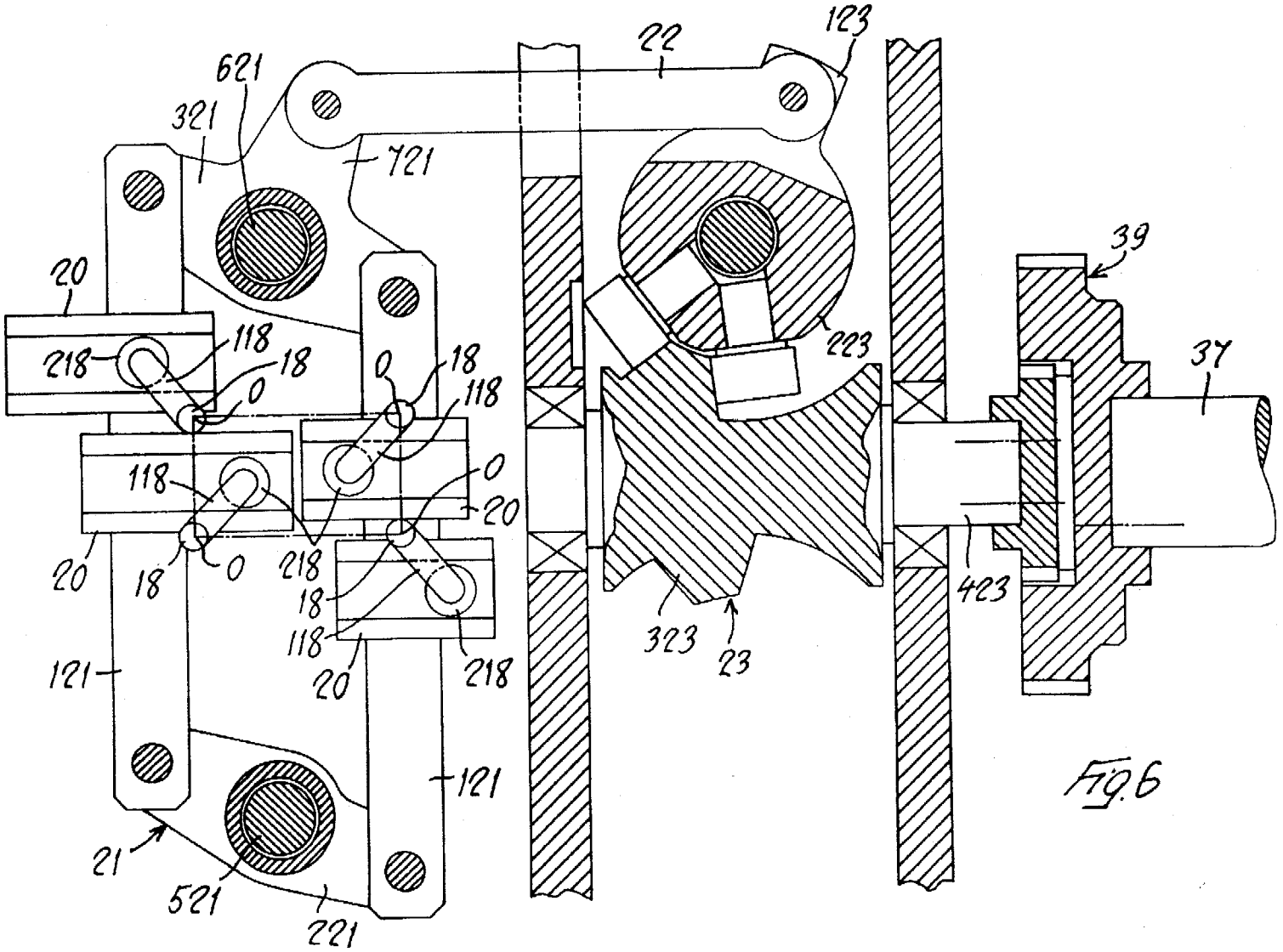
FIGS. 6 and 7 show the means of operating the folders for the flaps on the ends of the tubular wrapping, which are orientated tangentially to the direction of advance.
Figure 7:
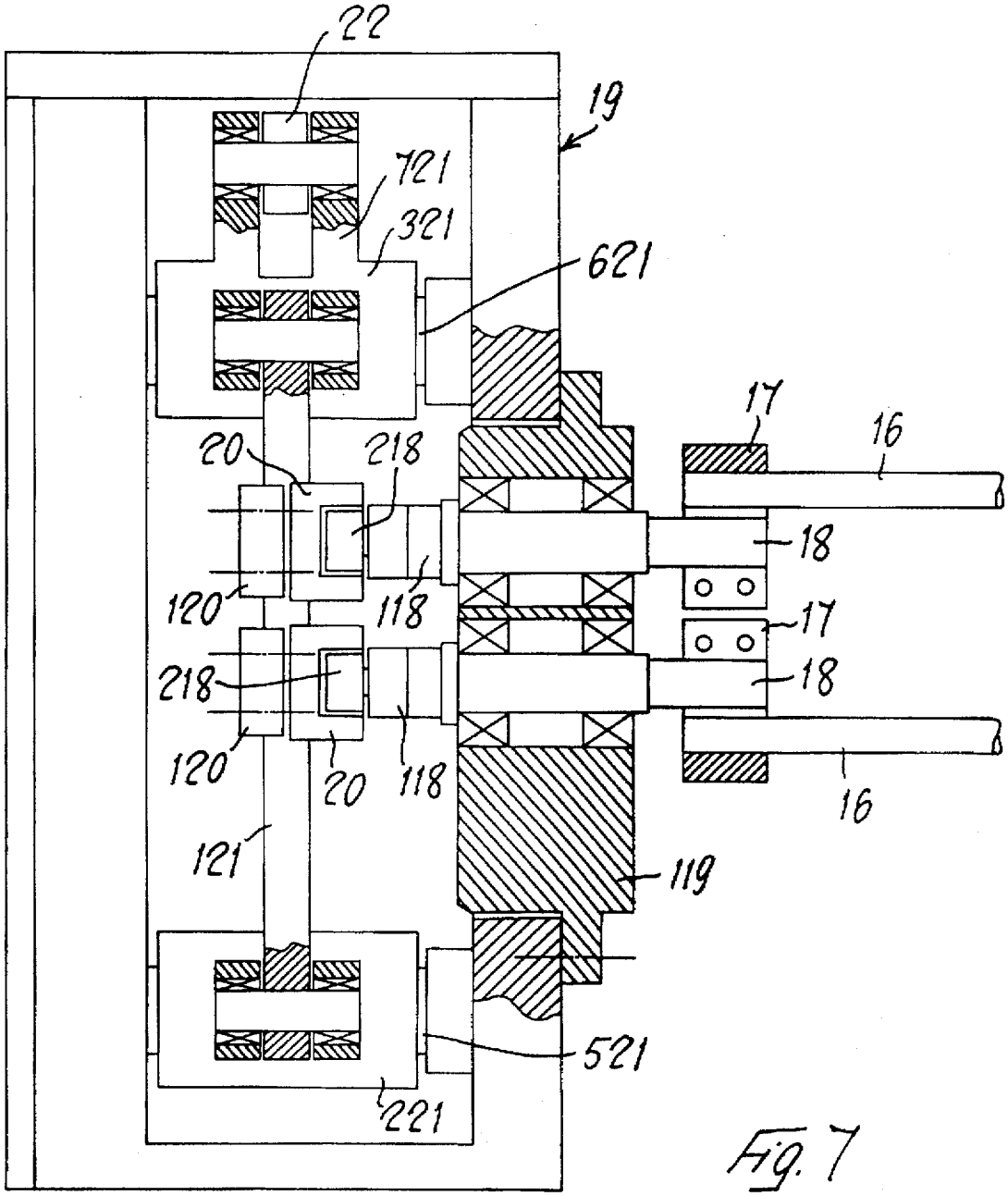
Figure 10:
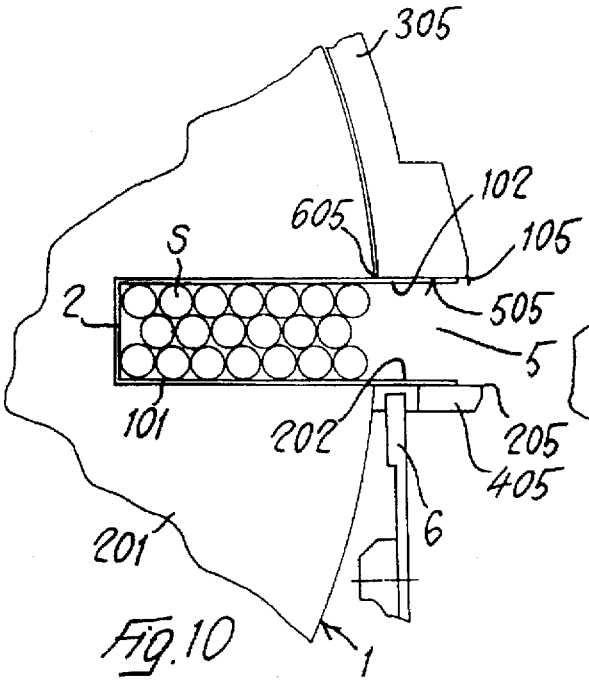
FIGS. 10 to 13 are schematic views of four stages of folding of the wrapping sheet for the formation of a tubular wrapping.

With reference to FIG. 5, the shafts 27, 28 are made to rotate in both directions and through angular distances which are variable according to the movement of the folding blades 25, 26 by means of a corresponding intermittent/oscillating drive device with parallel axes indicated overall by the numbers 30, 31, the cams 130, 131 of the two oscillators 30, 31 being mounted in axial alignment with each other on the same shaft 32, while each driving shaft 27, 28 of the folding blades 25, 26 rotates integrally with the roller support group 230, 231.

With reference to FIG. 1, to permit the presence of the radially outer folding blocks 15, the peripheral cylindrical wall 305 which surrounds the forming wheel 1 has an aperture, or rather an interruption 805 at the folding station P. Consequently, in order to keep the flaps 102, 202 on the radially outer side of the tubular wrapping in the folded position without interfering with the blocks 15, a retaining foot 33 is provided and is supported in such a way that it can be alternately brought closer to and distanced from the said side of the group of cigarettes wrapped in the tubular wrapping. The retaining foot 33 is slightly shorter than the axial extension of the corresponding side of the group of cigarettes S. The retaining foot 33 is carried at the end of a radial arm 134 of a system of articulated levers 34. The arm 34 is hinged, at an intermediate point and at its end opposite the foot 33, to a driven oscillating lever 234 and to an idle oscillating lever 334 respectively, the two levers being of identical length and having their axes of oscillation spaced apart by substantially the same distance as the axes of hinging to the radial arm 134. The lever 234 rotates integrally with a shaft 35. The foot 33 which has a contact surface orientated substantially parallel to the corresponding side of the group of cigarettes is therefore movable substantially alternately in the radial direction. The particular construction of the system of articulated levers makes it possible, in particular, to use the small components of motion in the direction transverse to the radial direction, in other words, in this case, parallel to the corresponding side of the group of cigarettes, in the sense that the said movement takes place at the end of the movement of contact with the tubular wrapping and in the direction of folding of the upper flap 102.

The operation of the folding blocks 15, the folding blades 25, 26 and the retaining foot 33 in synchronization with the steps of advance of the forming wheel 1 and with each other is obtained by taking, in some suitable way, the motive power from a common motor or from a common power take-off. With reference to FIGS. 1, 3, 5, 6, the driving shaft 35 of the retaining foot 33 is connected mechanically to the driven gear 9 from which the motion is taken for the forming wheel 1 and for the tangential folder 6 in a way similar to the latter. From the system for transmitting the motion to the tangential folder 6, the motion is transferred by means of a further gear 36 to a gear 137 keyed to a shaft 37. The rotary motion of the shaft 37 is converted into an alternating rotary motion of the shaft 35 by means of a transmission similar to that described with reference to the tangential folder 6. The rotary motion is transmitted to the parallel-axis oscillators 30, 31 driving the folding blades 25, 26, via removable rotating means 38 which couple the common input shaft 32 of the said oscillators 30, 31 to the driving shaft 10 of the tangential folder 6, while the rotary drive motion of the oscillator 23 is transmitted to the input shaft 423 of this oscillator by means 39 which couple the input shaft to the driving shaft 37 of the retaining foot 33 so that it rotates with it.

FIGS. 14 to 24 show some stages of the folding of the radial and tangential wings 402, 502, 602, 702 which form the end portions of the tubular wrapping projecting beyond the ends of the group of cigarettes. In the folding station P, the containing compartment 101 coincides with the slot 805 in the peripheral cylindrical wall 305 and the retaining foot 33 is brought next to the folded and overlapping axial flaps 102, 202 of the wrapping sheet 2 to retain them in position.

Figure 14:
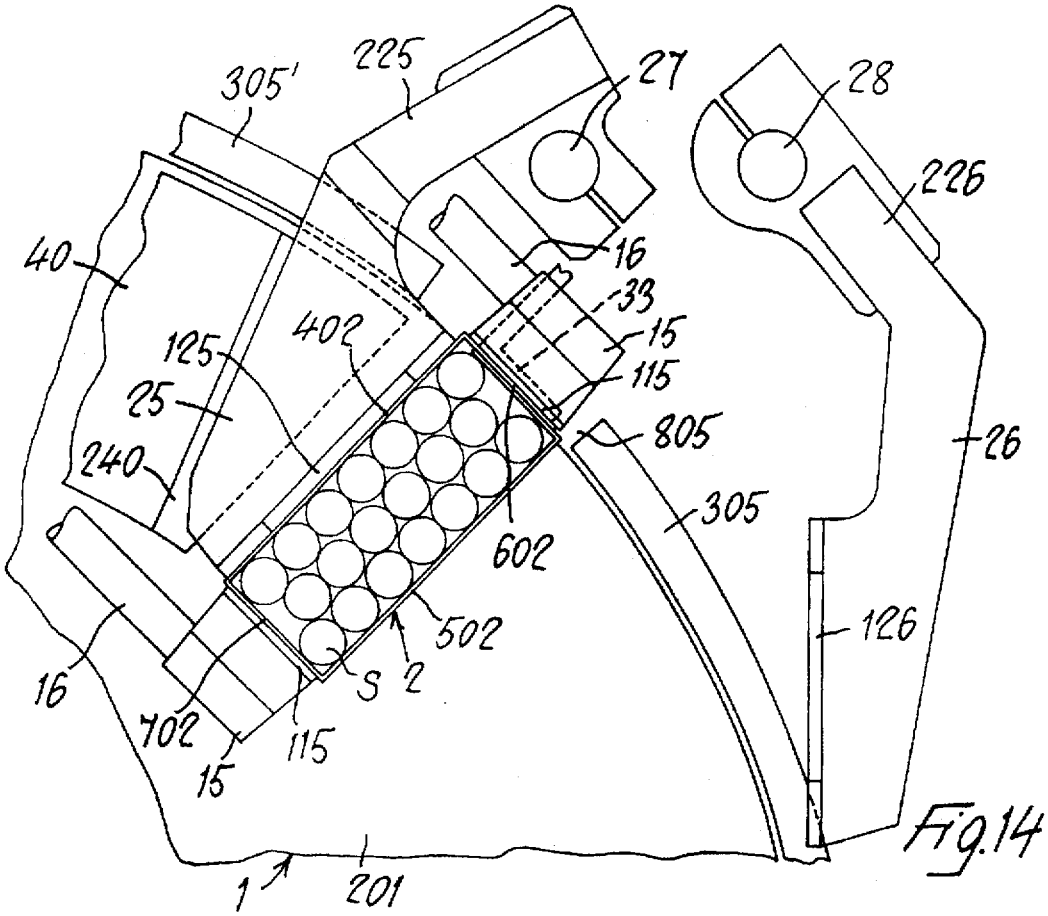
FIGS. 14 to 19 show, schematically and in relation to only one end of the ordered group of cigarettes, the stages of the closing of the tubular wrapping on the said end.
Figure 20:
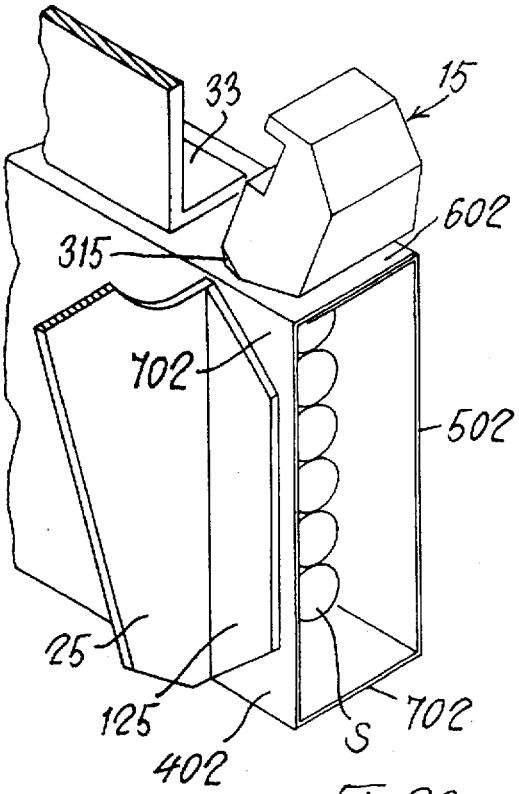
FIGS. 20 to 23 are perspective and more schematic views of the stages of folding the projecting flaps of the tubular wrapping as shown in FIGS. 14 to 20.
Figure 21:
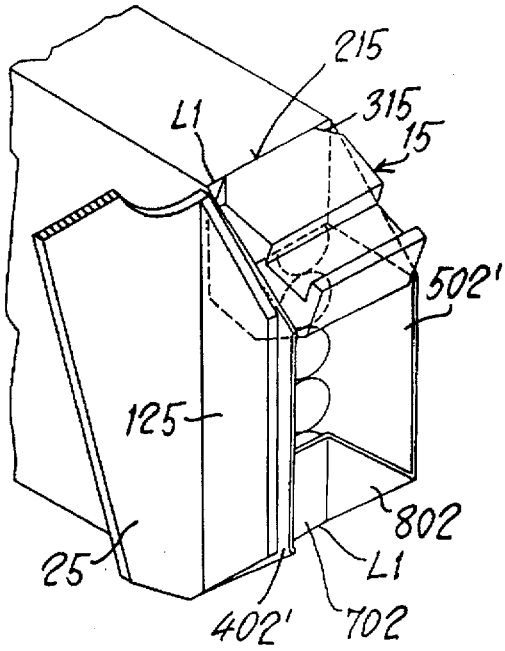
Figure 22:
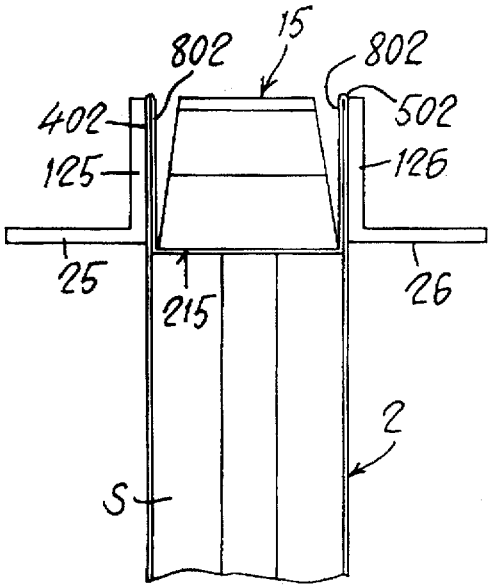
Figure 23:
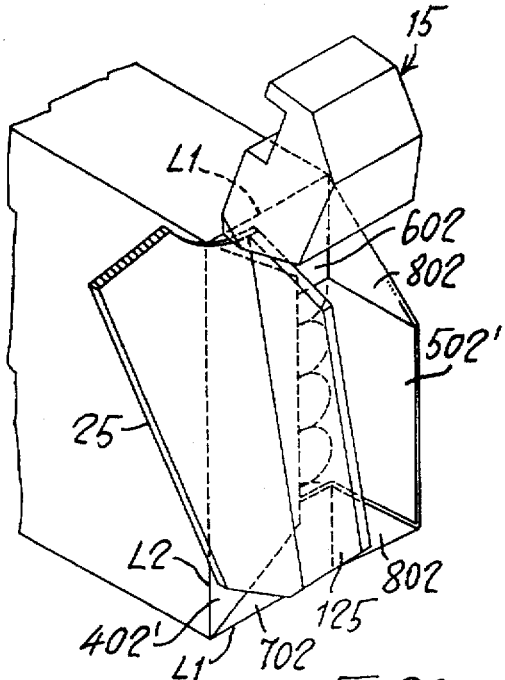

The front folding blades 25 are in the rest position, in which they are aligned with the extensions 125 and the folding corner with respect to the corresponding front radial wall of the compartment 101, so that the front radial wings 402 are made to bear on the extensions 125 of the blades 25. The blocks 15 are in the rest position (FIG. 9), with the edge 215 of the folding surface 115 disposed on the folding line L1 of the said tangential wings 602, 702, while the folding surface 115 diverges from the said wings 602, 702. This state is illustrated in FIGS. 14 and 20.

The rear folding blades 26 are then swung in the direction of advance of the forming wheel from a rest position in which they are remote from the wheel to a stand-by position in which they are aligned, similarly to the facing front folding blades 25, with the corresponding radial side of the containing compartment 101. In this way, the two radial wings 402, 502 projecting beyond the ends of the group of cigarettes are interposed between two associated containing walls, which prevent their bulging and/or deformation at the time of folding of the tangential wings 602, 702 which are joined as one piece with the first wings 402, 502 (see FIGS. 15 and 22).

Subsequently (FIGS. 16, 21 and 22), the blocks 15 are swung into the position in which they fold the associated tangential wings 602, 702 against the corresponding ends of the group of cigarettes S. In this state, since the tangential wings 602, 702 are joined along the axial corners to the radial wings 402, 502, a substantially triangular part 802 of the end of the radial wings 402, 502 is refolded, simultaneously with the folding of the tangential wings 602, 702, on to the inner side of the latter wings, while at the corner areas of the ends of the group of cigarettes, the wrapping material has to change from a substantially convex state to a substantially concave state. To prevent the wrapping sheet from tearing in the course of this change, during the folding of the tangential sides 602, 702, the corresponding corner area 315 of the folding block 15 is chamfered and/or rounded. This makes it possible to avoid tension on the wrapping sheet 2 in the said corner area and consequently in the change from the concave state to the convex state of the wrapping sheet which in some sense undergoes a movement, in particular a virtual rotation, around the corner 315. In this condition of folding, the radial sides 402' and 502' have a configuration in the form of an isosceles trapezium, whose longest base coincides with the folding line L2 of these sides; in other words, it is tangential to or coincident with the radial edge of the end of the group of cigarettes S.

Subsequently (see FIGS. 17 and 23), the folding blocks 15 are swung back into the rest position, while the front folding blade 25 is activated which, with an angular movement tangential to the end of the group of cigarettes and in a direction opposite the direction of advance of the wheel, causes the front radial flap 402' to be folded on to the end of the group of cigarettes and superimposed on the previously folded tangential wings 602 and 702. The whole process takes place at a speed which is greater than that of the elastic return of the tangential wings to their unfolded or partially folded state, and which in any case is sufficient to prevent them from assuming a position which would adversely affect the correct folding of the sheet on to the ends of the group of cigarettes.

At least the perpendicular extension 125 of the front folding blade 25 is of trapezoidal form, substantially corresponding to the trapezoidal form of the radial flaps 402', 502'. This enables the wait times of the operation of the folding blade 5 to be reduced, since the blade can start somewhat in advance, when the folding blocks 15 have executed only a part of the return movement and are in a position of intermediate elevation in which the angle between the folding surface 115 and the end of the group of cigarettes is slightly greater than the angle between the inclined sides and the base of the trapezoidal extension 125 of the folding blade 25. This blade may therefore be inserted under the folding blocks 15 while they are still at an intermediate point of the return movement.

Figure 18:
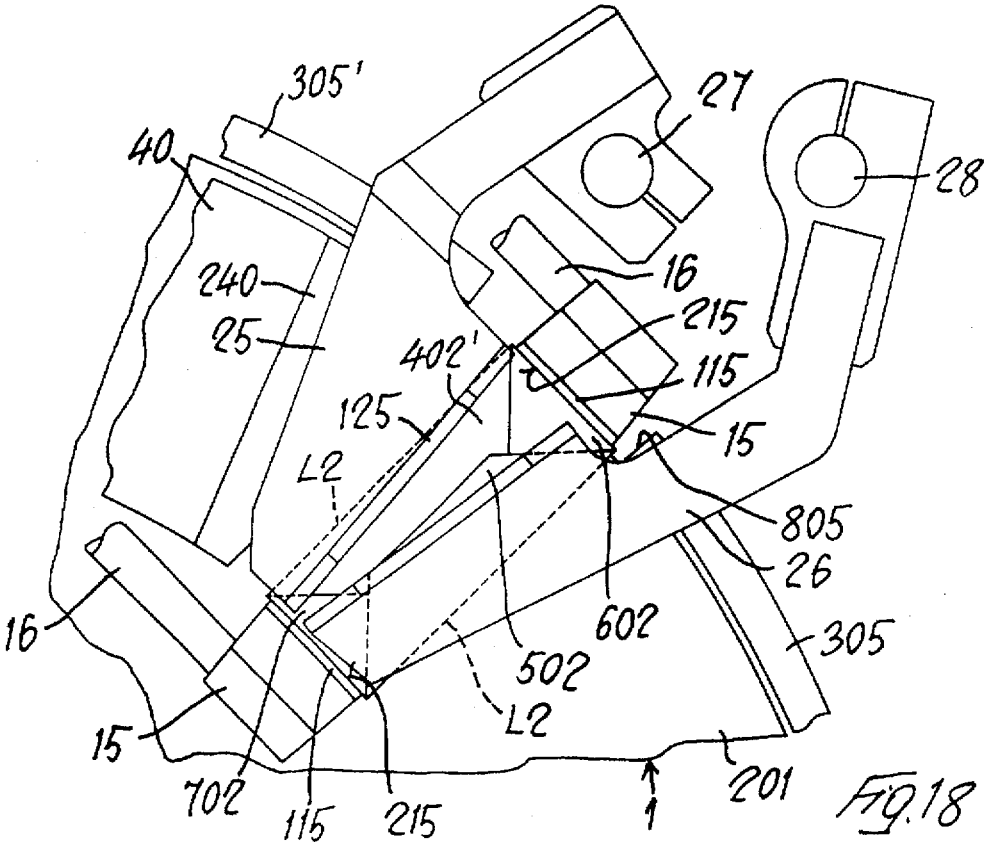

The rear folding blade 26 is operated before the start of the return movement of the front folding blade 25, and is swung in the direction of advance of the forming wheel 1 towards the front folding blade 25 until it reaches a certain distance from it. When the said minimum approach distance has been reached, the front folding blade 25 starts the return movement with a speed substantially equal to that of the rear folding blade 26. The folding movement of the rear folding blade 26 and the return movement of the front blade 25, as well as the path of the facing folding edges of the said folding blades 25, 26 and the minimum distance between them, are set in such a way that, in the end areas of the corresponding folding and return movements, the rear folding blade 26 is superimposed, directly or with the interposition of the rear radial flap 502 in the folded state, at least partially on the front radial flap 402, while the front blade 25 is still superimposed on the front end of the group of cigarettes (FIG. 18). In these conditions, the front radial flap 402 is kept in position both by the associated folding blade 25 and by the opposite folding blade 26.

Figure 19:
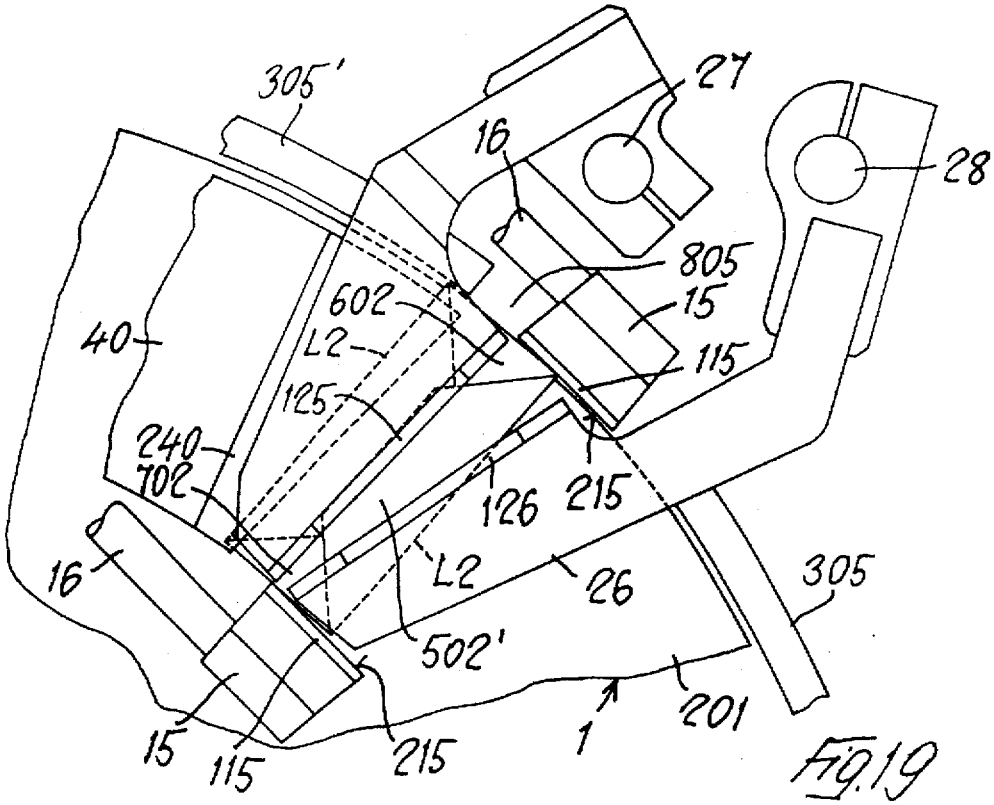
Figure 24:
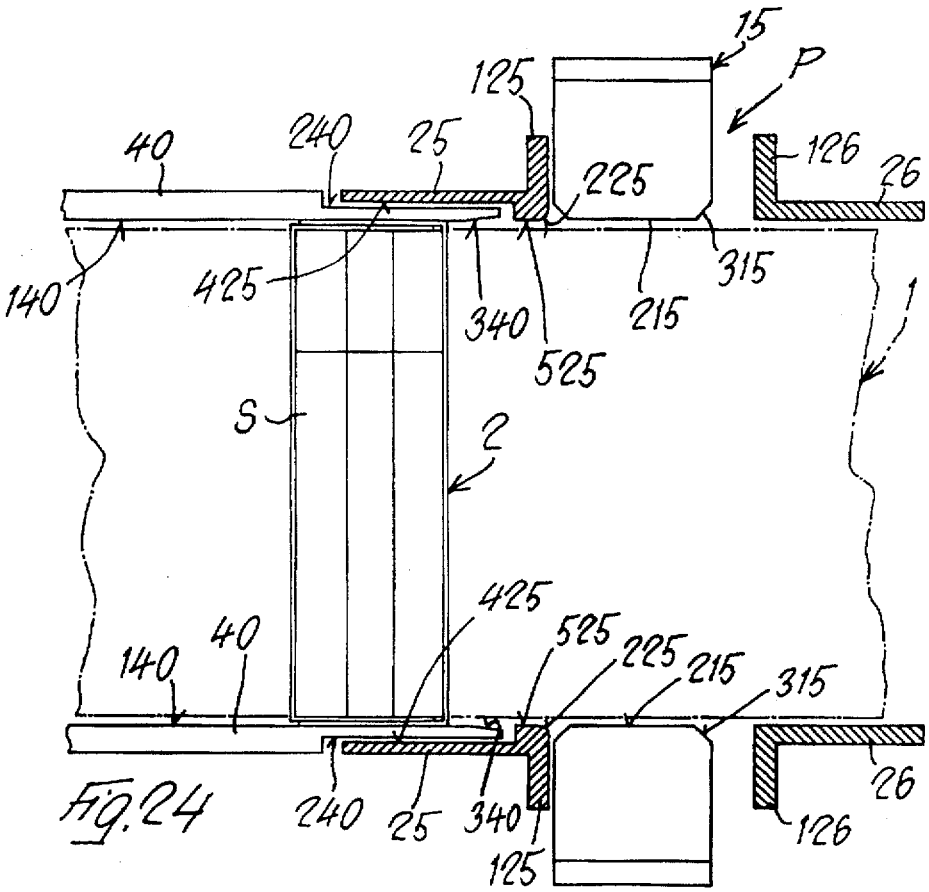
FIG. 24 shows the wrapped group of cigarettes at the point where it is released from the folding station and in combination with means for keeping the folded flaps in the folded state.
Figure 25:
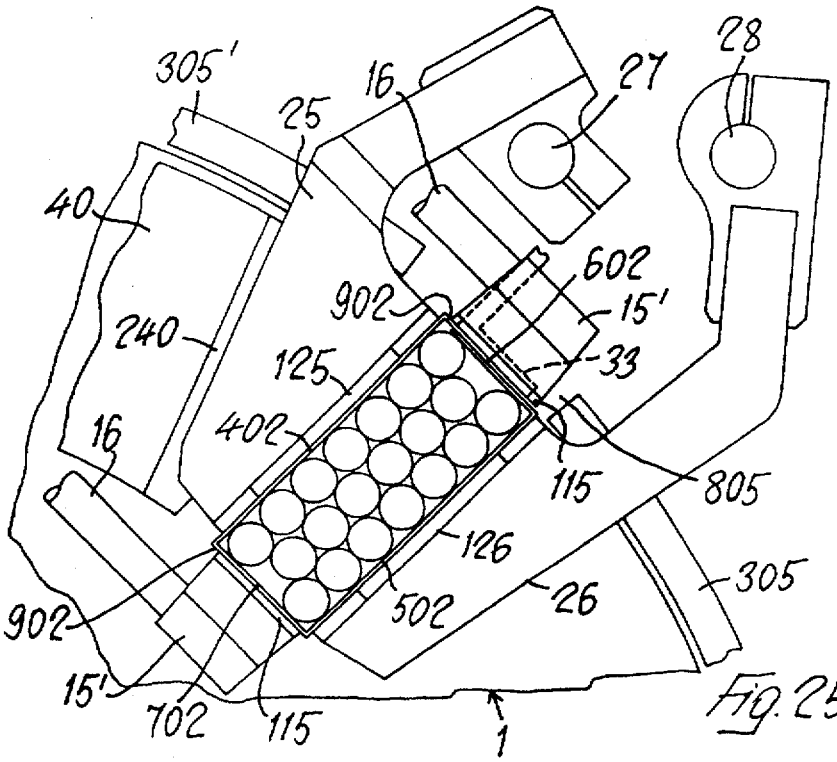
FIGS. 25 to 28 show some stages of the folding of the projecting ends of the tubular wrapping for closing the ends of the wrapping according to a variant embodiment of the invention.
Figure 28:
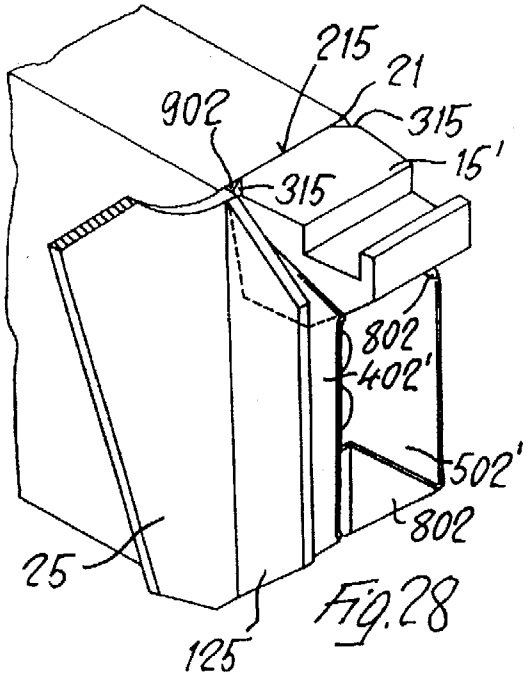
Figure 27:
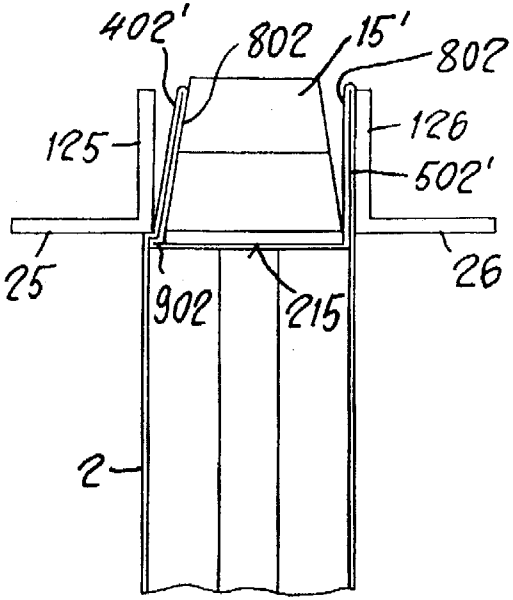

When this condition is reached, the forming wheel executes the step of advance, while the two folding blades 25, 26 end their simultaneous movement in the direction of advance of the forming wheel, with a certain delay with respect to the execution of the step of advance and at a speed lower than that of the step of advance of the compartments 101 (FIG. 19). The group of cigarettes is therefore moved with respect to the folding blades 25, 26 in the direction of advance of the wheel 1. The whole is adjusted and designed in such a way that, as shown in FIG. 19, the end of the rear and upper radial wing 502' which is free and faces the direction of advance of the forming wheel 1, is folded back and inserted under the folding edge of the front folding blade 25, while the rear blade 26 is still partially superimposed on an area on the opposite side of the said rear upper wing 502'. With reference to FIG. 24, the folding edge of the folding blade 25 has a chamfered or rounded guide portion 225 for this purpose.

In the subsequent arc of the path of the second step of advance, the forming wheel 1 is associated with an extension of the peripheral coaxial cylindrical wall 305' to keep the axial flaps 102, 202 folded, and with a sliding surface 140 of a lateral wall 40 on each side of the forming wheel 1, to keep the wings 402, 502, 602, 702 folded on the ends of the group of cigarettes, the upper rear wings 502' of the ends of the packaged group of cigarettes sliding against the direction of the fold along the said surfaces (see FIG. 24). To permit the passage from the area of the folding blade 25 to the stationary surface 140 without letting the wings 502' catch on the facing leading edge of the sliding surface 140, the front folding blades 25 and the leading portions of the lateral walls 40 forming the surfaces 140 facing these blades have complementary recesses or thinner areas for reciprocal engagement 425, 240 on the sides facing each other. The whole being such that, at the end of the movement in the direction of advance of the forming wheel 1, the folding blades 25 are engaged with the walls 40 whose inner surfaces are substantially flush with the inner surfaces of the portions 525 of the blades 25 on the side of the folding edge. The ends of the surfaces 140 directly adjacent to the inner surfaces 525 of the folding blades 25 may advantageously be made in the form of inclined guide surfaces 340 so that the ends of the said surfaces are lower than the surfaces 525 of the folding blades 25 and thus further reduce the risk of catching the free front edge of the upper rear wing 502 in the opposite direction to the fold.

In the embodiment illustrated, the walls 40, in other words the surfaces 140 and the wall 305', extend as far as the discharge station E on the side diametrically opposite the feed station A. However, FIG. 1 shows that the wrapping is perfectly formed when it leaves the second folding station P, and therefore the discharge station may be disposed at the end of the second step of advance of the forming wheel 1.

Figure 26:
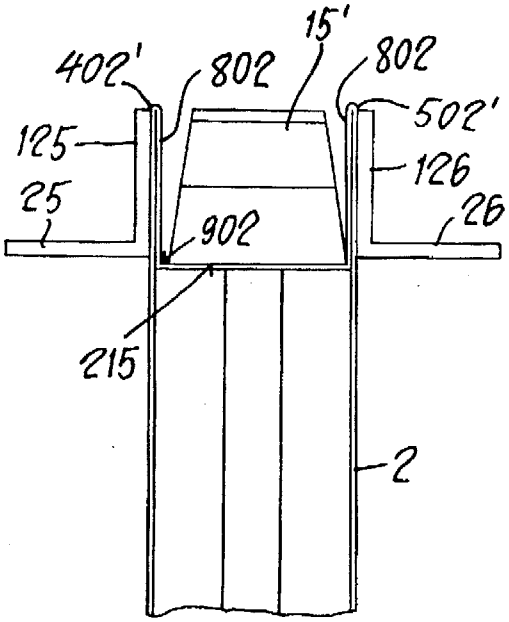

The folding procedure according to the preceding description, consisting in the operation in rapid succession of the folding means 6, 605, 15, 25, 26 at a speed easily higher than the speed of recovery, in other words of the elastic return of the folding flaps or wings 102, 202, 402, 502, 602, 702 in the folded position or in a position of intermediate folding, is not applicable to all wrapping materials. In particular, when sheets of polypropylene or of plastic material with a similar elastic behaviour or resistance to folding are used as wrapping materials, the operating speed required, particularly for the operation of the folding blocks 15 and of the front folding blade 25, may become excessively high. In order to avoid such problems, the invention provides a variant shown in FIGS. 25 to 28. In this variant, the edge 215 of the folding blocks 15 about which the blocks 15 oscillate does not have a length substantially identical to the side and to the tangential wing 602, 702, as in the preceding example shown in FIGS. 14 to 24, but, conversely, the edge 215' and consequently the blocks 15' are made shorter than the corresponding tangential wings 602, 702 on the side facing the front folding blade 25 and leave a strip 902 free on which an initial part of the radial wing 402 may be superimposed before the start of the return movement of the blocks 15. This is done by operating with a certain predetermined degree of advance of the front folding blade 25 for the execution of the folding movement with respect to the start of the return movement of the folding blocks 15. The dimensions of the peripheral strip 902, and the advance, as well as the speed of operation of the blocks 15' and of the front folding blade 25 are such that, when the strip has been overlapped by an amount sufficient to keep the tangential wings 602, 702 temporarily in the folded position, and at a predetermined minimum distance from the blocks 15 (FIG. 26), the blocks start their return movement to the rest position at a speed such that interference with the folding blade 25 is avoided.

I claim:

1. A device for packaging a group of cylindrical products in a wrapping sheet to form a packaged product, where the group has a predetermined number of the cylindrical products formed into a parallelepiped shape having a predetermined order corresponding to that of the packaged product and which group includes front and back sides, left and right sides, and top and bottom ends, the device comprising:

a feed station having (a) a combining means for combining the group with a wrapping sheet, said combining means including an orienting means for orienting the wrapping sheet at a predetermined position relative to the group and adjacent the left side of the group, an engaging means for engaging the left side of the group with the wrapping sheet, a compartment having a right opening, a closed left surface opposite to the right opening, opposed closed front and back surfaces, and opposed open top and bottom openings, and an inserting means for inserting the left side of the group and the engaged wrapping sheet through the right opening of the compartment and into engagement with the closed left surface of the compartment with the compartment being sized so that the opposed closed front and back surfaces are located closely adjacent the front and back sides of the group inserted therebetween, so that the wrapping sheet is folded by the closed front and back surfaces into a C shape about the group with (a) front-right and back-right flaps thereof extending away from the right side of the group and beyond the right opening of the compartment, (b) front-top and back-top wings extending away from the top end of the group and beyond the top opening of the compartment, (c) front-bottom and back-bottom wings extending away from the bottom end of the group and beyond bottom opening of the compartment, (d) a left-top wing extending between the front-top and back-top wings and beyond top opening of the compartment, and (e) a left-bottom wing extending between the front-bottom and back-bottom wings and beyond the bottom opening of the compartment; and (b) a forming means for forming the wrapping sheet into a tubular wrapping about the group, said forming means including a back-right flap folding means for folding the back-right flap toward the right side of the group in the compartment, and a front-right flap folding means for folding the front-right flap toward the right side of the group in the compartment whereby together the folded back-right and front-right flaps form (a) a right-top paired wing extending between the front-top wing and the back-top wing and (b) a right-bottom paired wing extending between the front-bottom wing and the back-bottom wing;

a folding station having a closing means for closing of the tubular wrapping about the group to form a wrapping enclosed group, said closing means including a top folding means for folding the left-top wing, the front-top wing, the back-top wing and the right-top paired wing against the top end of the group to enclose the top end of the group, said top folding means including a left-top wing folding member, a front-top wing folding member, a back-top wing folding member and a right-top paired wing folding member, a bottom folding means for folding the left-bottom wing, the front-bottom wing, the back-bottom wing and the right-bottom paired wing against the bottom end of the group to enclose the bottom end of the group, said bottom folding means including a left-bottom wing folding member, a front-bottom wing folding member, a back-bottom wing folding member and a right-bottom paired wing folding member, and an operating means for simultaneously operating said top folding means and said bottom folding means;

a discharge station including a discharging means for discharging of the wrapping enclosed group from the compartment; and a moving means (a) for moving the compartment containing the tubular wrapping and enclosed group from said feed station to said folding station, said moving means including a holding means for holding the front-right and back-right flaps in position against the right side of the group during movement of the compartment, and (b) for moving the compartment and wrapping enclosed group with the closed tubular wrapping held in an enclosed position about the group from said folding station to said discharge station.

2. A device for packaging as claimed in claim 1:

wherein said back-right flap folding means folds the back-right flap against the right side of the group leaving a peripheral strip of the back-right flap adjacent the front-right flap free from engagement with the back-right folding means;

wherein said front-right flap folding means folds the front-right flap against the back-right flap so that the front-right flap is at least partially superimposed on the back-right flap; and further including a controlling means for controlling movements of said back-right flap folding means such that (a) said back-right flap folding means completely folds the back-right flap against the right side and holds the back-right flap in place until an initial folding movement of said front-right flap folding means is made to at least partially superimpose the front-right flap on the peripheral strip of the back-right flap, and (b) said back-right flap folding means completes a return movement after the peripheral strip is superimposed by the front-right flap.

3. A device for packaging as claimed in claim 2:

wherein said back-right flap folding means includes a back-right folding surface having a back-right leading edge, said back-right folding surface being positioned at a stand-by position during insertion of the group and wrapping sheet in said compartment with said back-right leading edge coinciding with a folding line of the back-right flap; and wherein said front-right flap folding means includes a front-right surface having a front-right edge, said front-right folding surface being positioned at a stand-by position during insertion of the group and wrapping sheet in said compartment with said front-right leading edge coinciding with a folding line of the front-right flap.

4. A device for packaging as claimed in claim 3:

wherein said moving means moves said compartment circularly in a plane in a direction of advance and about a rotation axis perpendicular to plane, with said right opening of said compartment orientated radially outward from the rotation axis;

wherein said back-right folding surface and said front-right folding surface are disposed opposite to each other with respect to the direction of advance;

wherein said back-right flap folding means includes a means for moving said back-right folding surface alternately forwards and backwards to the direction of advance to effect the folding of the back-right flap against the right side;

wherein said front-right folding surface is stationary;

wherein said controlling means also controls said moving means such that the initial folding movement of said front-right flap folding means is accomplished by an initial movement of said compartment by said moving means in the direction of advance whereby a relative movement of the stationary front-right folding surface and the compartment accomplishes the initial folding movement.

5. A device for packaging as claimed in claim 1:

wherein said left-top wing folding member includes a left-top surface having a left-top free edge, and wherein said top folding means includes a left-top surface moving means for moving said left-top surface to a left-top stand-by position where said left-top surface is substantially aligned with and externally superimposed on said left-top wing with said left-top free edge substantially coinciding with a left-top folding line of the left-top wing and then for moving said left-top surface by oscillation about the left-top free edge to a left-top folded position where the left-top wing is folded about the left-top folding line against the top end of the group and back to the left-top stand-by position;

wherein said right-top wing folding member includes a right-top surface having a right-top free edge, and wherein said top folding means includes a right-top surface moving means for moving said right-top surface to a right-top stand-by position where said right-top surface is substantially aligned with and externally superimposed on said right-top wing with said right-top free edge substantially coinciding with a right-top folding line of the right-top wing and then for moving said right-top surface by oscillation about the right-top free edge to a right-top folded position where the right-top wing is folded about the right-top folding line against the top end of the group and back to the right-top stand-by position;

wherein said left-bottom wing folding member includes a left-bottom surface having a left-bottom free edge, and wherein said top folding means includes a left-bottom surface moving means for moving said left-bottom surface to a left-bottom stand-by position where said left-bottom surface is substantially aligned with and externally superimposed on said left-bottom wing with said left-bottom free edge substantially coinciding with a left-bottom folding line of the left-bottom wing and then for moving said left-bottom surface by oscillation about the left-bottom free edge to a left-bottom folded position where the left-bottom wing is folded about the left-bottom folding line against the bottom end of the group and back to the left-bottom stand-by position;

wherein said right-bottom wing folding member includes a right-bottom surface having a right-bottom free edge, and wherein said top folding means includes a right-bottom surface moving means for moving said right-bottom surface to a right-bottom stand-by position where said right-bottom surface is substantially aligned with and externally superimposed on said right-bottom wing with said right-bottom free edge substantially coinciding with a right-bottom folding line of the right-bottom wing and then for moving said right-bottom surface by oscillation about the right-bottom free edge to a right-bottom folded position where the right-bottom wing is folded about the right-bottom folding line against the bottom end of the group and back to the right-bottom stand-by position;

wherein said back-top wing folding member includes a back-top blade having a back-top folding edge, and wherein said top folding means includes a back-top blade moving means for moving said back-top blade to a back-top stand-by position where said back-top folding edge of said back-top blade is adjacent to a back-top folding line of the back-top wing and then for moving said back-top blade by sliding movement parallel to said top end of the group to a back-top folded position where the back-top wing is folded about the back-top folding line against the top end of the group and back to the back-top stand-by position;

wherein said front-top wing folding member includes a front-top blade having a front-top folding edge, and wherein said top folding means includes a front-top blade moving means for moving said front-top blade to a front-top stand-by position where said front-top folding edge of said front-top blade is adjacent to a front-top folding line of the front-top wing and then for moving said front-top blade, after said back-bottom blade has been moved back to the back-bottom stand-by position, by sliding movement parallel to said top end of the group to a front-top folded position where the front-top wing is folded about the front-top folding line against the back-bottom wing folded on the top end of the group and back to the front-top stand-by position;

wherein said back-bottom wing folding member includes a back-bottom blade having a back-bottom folding edge, and wherein said bottom folding means includes a back-bottom blade moving means for moving said back-bottom blade to a back-bottom stand-by position where said back-bottom folding edge of said back-bottom blade is adjacent to a back-bottom folding line of the back-bottom wing and then for moving said back-bottom blade by sliding movement parallel to said bottom end of the group to a back-bottom folded position where the back-bottom wing is folded about the back-bottom folding line against the bottom end of the group and back to the back-bottom stand-by position; and wherein said front-bottom wing folding member includes a front-bottom blade having a front-bottom folding edge, and wherein said bottom folding means includes a front-bottom blade moving means for moving said front-bottom blade to a front-bottom stand-by position where said front-bottom folding edge of said front-bottom blade is adjacent to a front-bottom folding line of the front-bottom wing and then for moving said front-bottom blade, after said back-bottom blade has been moved back to the back-bottom stand-by position, by sliding movement parallel to said bottom end of the group to a front-bottom folded position where the front-bottom wing is folded about the front-bottom folding line against the back-bottom wing folded on the bottom end of the group and back to the front-bottom stand-by position.

6. A device for packaging as claimed in claim 5:

wherein said left-top surface, said right-top surface, said left-bottom surface, said right-bottom surface, said front-top blade and said front-bottom blade are all positioned in the respective stand-by positions as said moving means moves the compartment containing the tubular wrapping to said folding station and in-between said left-top surface, said right-top surface, said left-bottom surface, said right-bottom surface, said front-top blade and said front-bottom blade.

7. A device for packaging as claimed in claim 6:

wherein each of said surfaces of said wing folding members is part of an associated block;

wherein a portion of each said surface of each said wing folding member parallel to an associated folding line is substantially equal in length to the associated folding line; and wherein each said free edge of each said surface below an associated said portion forms opposite corners with other surfaces of the associated said block each of which said corners is dulled so that easy passage of the corner past an associated front or bottom wing in an unfolded position is facilitated.

8. A device for packaging as claimed in claim 7:

wherein each said block has a trapezoidal cross section when viewed perpendicular to the associated said surface.

9. A device for packaging as claimed in claim 5:

wherein each of said surfaces of said wing folding members is part of an associated block; and wherein each of said free edges of said surfaces terminates a short distance from an associated said front-top or front-bottom wing so that a strip of the associated said wing is left free from engagement by said free edge during folding thereof and such that an associated folding edge of an associated said blade advances onto an associated strip during a return movement of an associated said block without collision between a returning free edge and an advancing said folding edge.

10. A device for packaging as claimed in claim 9:

wherein each said blade includes an associated extension which is located parallel and immediately adjacent an associated front or back wing when the associated said blade is in the stand-by position; and wherein before any of said surface moving means are oscillated, each said blade moving means moves the associated said blade to the stand-by position.

11. A device for packaging as claimed in claim 10:

wherein each said extension has a trapezoidal shape which mates with a trapezoidal shape assumed by associated said front and back wings after said left and right wings have been folded by said surfaces; and wherein each said blade moving means commences movement of the associated said blade when the associated said surface moving means has moved the associated said surface to an intermediate position, the intermediate position being on the way back between the folded position and the stand-by position, where movement of the trapezoidal shaped associated blade does not come into contact with the associated said block.

12. A device for packaging as claimed in claim 5:

wherein the cylindrical products have longitudinal axes extending between said top and bottom openings of said compartment, and said cylindrical products in said compartment are moved by said moving means in a direction of transport perpendicular to the longitudinal axes of said cylindrical products;

wherein said front-top blade moving means and said front-bottom blade moving means each include a common front shaft to which said front-top blade and said front-bottom blade are attached and which said front shaft is rotated in an oscillatory motion from a front stand-by position where associated said folding edges are adjacent associated said folding lines to a front folding position where associated said folding edges are inclined to associated said folding lines and back to effect the folding of said front-top wing and said front-bottom wing; and wherein said back-top blade moving means and said back-bottom blade moving means each include a common back shaft to which said back-top blade and said back-bottom blade are attached and which said back shaft is rotated in an oscillatory motion (a) from a back stand-by position where associated said folding edges are adjacent associated said folding lines (b) to a back folding position where associated said folding edges are inclined to associated said folding lines and an associated said back wing is superimposed on an opposite said front wing held in place by an associated said front blade which is spaced from an associated said back blade and rotating back to the stand-by position together as the associated said back blade moves to the folding position to maintain the spacing and (c) back to effect the folding of said back-top wing and said back-bottom wing.

13. A device for packaging as claimed in claim 5:

wherein each of said surfaces of said wing folding members is part of an associated block; and wherein each of said surface moving means includes a support attached to a side of the associated said block substantially opposite to the associated said free edge.

14. A device for packaging as claimed in claim 13:

wherein each of said surfaces of said wing folding members in the stand-by position are orientated to diverge outwardly from the associated said wing beginning at the associated free edge thereof.

15. A device for packaging as claimed in claim 13:

wherein each said surface moving means includes:

a driving shaft rotatable about a drive axis coincident with an associated folding line, a bar attached to an associated said block and extending parallel to an associated folding line, a radial arm connecting said driving shaft to said bar, a crank attached to said driving shaft; and rotating means for rotating said crank and hence said driving shaft about the drive axis in alternate directions through a predetermined rotation angle.

16. A device for packaging as claimed in claim 15:

wherein each of said driving shafts is movably mounted to a common plate;

wherein each of said rotating means are mounted together in a casing; and further including a mounting means for mounting said plate to said casing so as to connect respective said shafts to respective said rotating means in said casing, whereby different dimensions of groups can be accommodated easily by different said plates and associated said shafts.

17. A device for packaging as claimed in claim 13:

wherein said moving means moves said compartment such that said front side is perpendicular to a direction of movement; and wherein said holding means of said moving means includes a stationary wall extending from the right opening of said compartment when said compartment is in said feed station and parallel to the direction of movement of said compartment such that the front-right flap superimposed over the back-right flap and hence over the right side of the group is held in place against the right side of the group by sliding contact with said stationary wall as said compartment is moved from said feed station to said folding station.

18. A device for packaging as claimed in claim 17:

wherein said stationary wall also extends from said folding station to said discharge station to maintain the front-right flap in place during movement of the compartment from said folding station to said discharge station, said stationary wall having an aperture at said folding station; and wherein said holding means further includes a removable means for maintaining the front-right flap superimposed over the back-right flap in place against the right side of the group when said front-right flap is located in the aperture of said stationary wall.

19. A device for packaging as claimed in claim 18:

wherein said moving means further includes a top wall extending from the aperture of the stationary wall adjacent the top end of the group when the group is in the folding station and in the direction of movement to said discharge station such that the top wings folded by said top folding means are held in a folded position against the top end of the group by sliding contact with said top wall as said compartment is moved from said feed station to said folding station, and a bottom wall extending from the aperture of the stationary wall adjacent the bottom end of the group when the group is in the folding station and in the direction of movement to said discharge station such that the bottom wings folded by said bottom folding means are held in a folded position against the bottom end of the group by sliding contact with said bottom wall as said compartment is moved from said feed station to said folding station.

20. A device for packaging as claimed in claim 19:

wherein said top folding means folds the back-bottom wing over the left-top wing, the front-top wing and the right-top wing such that the folded back-bottom wing has a top leading edge foremost in the direction of advance;

wherein said bottom folding means folds the back-bottom wing over the left-bottom wing, the front-bottom wing and the right-bottom wing such that the folded back-bottom wing has a bottom leading edge foremost in the direction of advance;

wherein said front-top movable blade includes a front-top edge portion which is aligned with said top wall in the direction of advance and an upstream recessed portion adjacent to said front-top edge portion in which a top portion of said top wall is received such that said front-top edge portion forms a guide under which said top leading edge is advanced and thus lead into sliding contact with said top portion of said top wall; and wherein said front-bottom movable blade includes a front-bottom edge portion which is aligned with said bottom wall in the direction of advance and an upstream recessed portion adjacent to said front-bottom edge portion in which a bottom portion of said bottom wall is received such that said front-bottom edge portion forms a guide under which said bottom leading edge is advanced and thus lead into sliding contact with said bottom portion of said bottom wall.

21. A device for packaging as claimed in claim 20:

wherein said top and bottom leading edges are dulled for easy passage of a respective said top and bottom leading edge there-past; and wherein said front-top edge portion and said front-bottom edge portion each have a wedge shaped end located adjacent a respective said top leading edge and bottom leading edge there-past.

22. A device for packaging as claimed in claim 21:

further including a synchronizing means for synchronizing (a) said moving means, (b) said left-top, right-top, left-bottom and right-bottom surface moving means, and (c) said back-bottom, front-top, back-bottom and front-bottom blade moving means, such that (a) said front-top blade moving means moves said front-top blade to the folded position and then (b) said back-bottom blade moving means moves said back-bottom blade toward the folded position, prior to a start of a return movement by said front-top blade moving means of said front-top blade to the stand-by position, with said back-bottom blade being brought to a certain top minimum distance from said front-top blade at least when said front-top blade has returned to the stand-by position and said back-bottom blade is at the folding position, and such that (a) said front-bottom blade moving means moves said front-bottom blade to the folded position simultaneously with the movement of said front-top blade to the folded position, and then (b) said back-bottom blade moving means moves said back-bottom blade toward the folded position, simultaneously with the movement of said back-top blade toward the folded position, and prior to a start of a return movement by said front-bottom blade moving means of said front-bottom blade to the stand-by position which is simultaneous with the start of the return movement by said front-top blade, with said back-bottom blade being brought to a certain top minimum distance from said front-bottom blade at least when said front-bottom blade has returned to the stand-by position and said back-bottom blade is at the folding position, and such that said moving means moves said compartment from said folding station to said discharge station when said front-top blade has returned to the stand-by position and said back-bottom blade is at the folding position and said front-bottom blade has returned to the stand-by position and said back-bottom blade is at the folding position.

23. A device for packaging as claimed in claim 22:

wherein said moving means includes a power take-off which drives said moving means; and further including a mechanical transmission system powered by said power take-off which drives said forming means and said closing means.

24. A device for packaging as claimed in claim 23:

wherein said moving means includes a forming wheel having a rotation axis and in which a plurality of said compartments are provided at a peripheral edge thereof, said compartments being equal angularly spaced about the peripheral edge with said right opening of said compartments at the peripheral edge; and wherein said forming means wraps said wrapping sheet about an axis parallel to the rotation axis.

25. A process for packaging a group of cylindrical products in a wrapping sheet to form a packaged product, where the group has a predetermined number of the cylindrical products formed into a parallelepiped shape having a predetermined order corresponding to that of the packaged product and which group includes front and back sides, left and right sides, and top and bottom ends, the process comprising the steps of:

combining, at a feed station, the group with a wrapping sheet, said combining step including the steps of orienting the wrapping sheet at a predetermined position relative to the group and adjacent the left side of the group, engaging the left side of the group with the wrapping sheet, and inserting the left side of the group and the engaged wrapping sheet through a right opening of a compartment and into engagement with a closed left surface of the compartment opposite to the right opening, the compartment also including opposed closed front and back surfaces located closely adjacent the front and back sides of the group inserted therebetween and opposed top and bottom openings, so that the wrapping sheet is folded by the closed front and back surfaces into a C shape about the group with (a) front-right and back-right flaps thereof extending away from the right side of the group and beyond the compartment, (b) front-top and back-top wings extending away from the top end of the group and beyond the compartment, (c) front-bottom and back-bottom wings extending away from the bottom end of the group and beyond the compartment, (d) a left-top wing extending between the front-top and back-top wings and beyond the compartment, and (e) a left-bottom wing extending between the front-bottom and back-bottom wings and beyond the compartment;

forming, at the feed station, the wrapping sheet into a tubular wrapping about the group, said forming step including the steps of folding the back-right flap toward the right side with a back-right flap folding member, and folding the front-right flap toward the right side with a front-right flap folding member whereby together the folded back-right and front-right flaps form (a) a right-top paired wing extending between the front-top wing and the back-top wing and (b) a right-bottom paired wing extending between the front-bottom wing and the back-bottom wing;

moving the compartment containing the tubular wrapping and enclosed group to a folding station, said moving step including the step of holding the front-right and back-right flaps in position against the right side of the group during movement of the compartment;

closing, at the folding station, the tubular wrapping about the group to form a wrapping enclosed group, said closing step including the simultaneous steps of folding the left-top wing, the front-top wing, the back-top wing and the right-top paired wing against the top end of the group to close the top of the group respectively with a left-top wing folding member, a front-top wing folding member, a back-top wing folding member and a right-top paired wing folding member, and folding the left-bottom wing, the front-bottom wing, the back-bottom wing and the right-bottom paired wing against the bottom end of the group to close the bottom of the group respectively with a left-bottom wing folding member, a front-bottom wing folding member, a back-bottom wing folding member and a right-bottom paired wing folding member;

moving the compartment and wrapping enclosed group with the closed tubular wrapping held in an enclosed position about the group from the folding station to a discharge station; and discharging of the wrapping enclosed group from the compartment at the discharge station.

26. A process for packaging as claimed in claim 25:

wherein said moving step moves the compartment directly from the feed station to the folding station.

27. A process for packaging as claimed in claim 26:

wherein said folding of the back-right flap step folds the back-right flap against the right side of the group with the folding beginning at an edge formed by the back side and right side;

wherein said folding of the front-right flap step folds the front-right flap against the back-right flap with the folding beginning at an edge formed by the front side and right side so that said front-right flap is at least partially superimposed on the back-right flap, a folding movement of the front-right folding member in folding the front-right flap being accomplished as the back-right folding member retreats from a folding movement of the back-right flap at a speed higher than a speed of elastic return of the back-right flap; and wherein said step of moving the compartment and wrapping enclosed group includes the step of holding the back-right and front-right flaps in position against the right side of the group.

28. A process for packaging as claimed in claim 27:

wherein said folding of the back-right flap step with the back-right folding member leaves a peripheral strip of the back-right flap adjacent the front-right flap free from engagement with the back-right folding member for subsequent superimposition with the front-right flap; and wherein said folding of the front right flap step with the front-right folding member includes moving of the back-right folding member out of engagement with the back-right flap once the peripheral strip has been superimposed by a corresponding strip of the front-right flap as the front-right flap is moved toward the right side.

* * * * *